US010493588B2

(12) United States Patent
Seki et al.

(10) Patent No.: US 10,493,588 B2
(45) Date of Patent: Dec. 3, 2019

(54) POLISHING APPARATUS AND POLISHING METHOD

(71) Applicant: EBARA CORPORATION, Tokyo (JP)

(72) Inventors: Masaya Seki, Tokyo (JP); Tetsuji Togawa, Tokyo (JP); Masayuki Nakanishi, Tokyo (JP); Naoki Matsuda, Tokyo (JP); Atsushi Yoshida, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 475 days.

(21) Appl. No.: 14/618,426

(22) Filed: Feb. 10, 2015

(65) Prior Publication Data

US 2015/0151398 A1 Jun. 4, 2015

Related U.S. Application Data

(62) Division of application No. 13/308,857, filed on Dec. 1, 2011, now Pat. No. 8,979,615.

(30) Foreign Application Priority Data

Mar. 25, 2011 (JP) ..... 2011-067211
Nov. 11, 2011 (JP) ..... 2011-247228

(51) Int. Cl.
*B24B 21/00* (2006.01)
*B24B 9/06* (2006.01)
*B24B 21/20* (2006.01)

(52) U.S. Cl.
CPC ..... *B24B 21/002* (2013.01); *B24B 9/065* (2013.01); *B24B 21/006* (2013.01); *B24B 21/008* (2013.01); *B24B 21/20* (2013.01)

(58) Field of Classification Search
CPC ..... B24B 9/026; B24B 47/26; B24B 21/002; B24B 21/004; B24B 21/02; B24B 21/14
(Continued)

(56) References Cited

U.S. PATENT DOCUMENTS 3,715,839 A * 2/1973 Heesemann ..... B24B 21/002 451/168
5,065,547 A * 11/1991 Shimizu ..... B24B 21/004 451/296

(Continued)

FOREIGN PATENT DOCUMENTS

CN 1287040 3/2001
EP 2 067 571 6/2009

(Continued)

OTHER PUBLICATIONS

Extended European Search Report dated Nov. 14, 2016 in corresponding European Application No. 12001940.1.

(Continued)

*Primary Examiner* — Monica S Carter
*Assistant Examiner* — Marcel T Dion
(74) *Attorney, Agent, or Firm* — Wenderoth, Lind & Ponack, L.L.P.

(57) ABSTRACT

The polishing apparatus has a polishing unit capable of polishing a peripheral portion of the substrate to form a right-angled cross section. The polishing apparatus includes: a substrate holder that holds and rotates the substrate; guide rollers that support a polishing tape; and a polishing head having a pressing member that presses an edge of the polishing tape against the peripheral portion of the substrate from above. The guide rollers are arranged such that the polishing tape extends parallel to a tangential direction of the substrate and a polishing surface of the polishing tape is parallel to a surface of the substrate. The substrate holder includes: a holding stage that holds the substrate; and a supporting stage that supports a lower surface of the peripheral portion of the substrate in its entirety. The supporting stage rotates in unison with the holding stage.

14 Claims, 37 Drawing Sheets

(58) Field of Classification Search
USPC ..... 451/44, 168, 173
See application file for complete search history.

(56) References Cited

U.S. PATENT DOCUMENTS

| | | | | |
|---|---|---|---|---|
| 5,885,143 | A * | 3/1999 | Ichikawa | B24B 7/17 451/168 |
| 6,110,025 | A | 8/2000 | Williams et al. | |
| 6,283,838 | B1 | 9/2001 | Blake et al. | |
| 6,402,596 | B1 | 6/2002 | Hakomori et al. | |
| 7,014,529 | B1 * | 3/2006 | Kubota | B24B 9/065 451/168 |
| 7,108,582 | B2 | 9/2006 | Sato et al. | |
| 7,115,023 | B1 * | 10/2006 | Owczarz | B24B 9/065 451/303 |
| 7,351,131 | B2 * | 4/2008 | Nakamura | B24B 9/065 257/E21.237 |
| 7,682,225 | B2 * | 3/2010 | Hongo | B24B 9/065 451/168 |
| 2002/0098787 | A1 * | 7/2002 | Kunisawa | B24B 9/065 451/307 |
| 2002/0160693 | A1 | 10/2002 | Nihonmatsu et al. | |
| 2004/0106363 | A1 * | 6/2004 | Ishii | B24B 9/065 451/65 |
| 2004/0185751 | A1 * | 9/2004 | Nakanishi | B24B 9/065 451/5 |
| 2008/0293336 | A1 | 11/2008 | Zhang et al. | |
| 2009/0124174 | A1 | 5/2009 | Fukushima et al. | |
| 2009/0142992 | A1 | 6/2009 | Takahashi et al. | |
| 2009/0227189 | A1 | 9/2009 | Maeda et al. | |
| 2009/0275269 | A1 * | 11/2009 | Sakairi | B24B 9/065 451/44 |
| 2010/0105291 | A1 * | 4/2010 | Ettinger | B24B 1/04 451/8 |
| 2010/0178851 | A1 | 7/2010 | Nakanishi et al. | |
| 2012/0244787 | A1 | 9/2012 | Seki et al. | |

FOREIGN PATENT DOCUMENTS

| | | |
|---|---|---|
| JP | 57-8068 | 1/1982 |
| JP | 58-165958 | 10/1983 |
| JP | 60-67842 | 5/1985 |
| JP | 04-085827 | 3/1992 |
| JP | 4-135701 | 12/1992 |
| JP | 08-001494 | 1/1996 |
| JP | 08-097111 | 4/1996 |
| JP | 2001-198781 | 7/2001 |
| JP | 2001-205549 | 7/2001 |
| JP | 2001-347447 | 12/2001 |
| JP | 2002-126981 | 5/2002 |
| JP | 2009-154285 | 7/2009 |
| JP | 2009-208214 | 9/2009 |
| JP | 2010-201546 | 9/2010 |

OTHER PUBLICATIONS

English translation of Office Action dated Dec. 5, 2017 in corresponding Japanese Application No. 2017-032907.

* cited by examiner

POLISHING APPARATUS AND POLISHING METHOD

BACKGROUND OF THE INVENTION

Field of the Invention

The present invention relates to a polishing apparatus and a polishing method for polishing a peripheral portion of a substrate, such as a semiconductor wafer, and more particularly to a polishing apparatus and a polishing method for polishing a peripheral portion of a substrate by pressing a polishing tape against the peripheral portion of the substrate.

Description of the Related Art

From a viewpoint of improving yield in fabrication of semiconductor devices, management of surface conditions of a peripheral portion of a substrate has been attracting attention in recent years. In the fabrication process of the semiconductor devices, various materials are deposited on a silicon wafer to form a multilayer structure. As a result, unwanted films and roughened surface are formed on a peripheral portion of the substrate. It has been a recent trend to transport the substrate by holding only its peripheral portion using arms. Under such circumstances, the unwanted films remaining on the peripheral portion would be peeled off during various processes and could adhere to devices, causing lowered yield. Thus, in order to remove the unwanted films, the peripheral portion of the substrate is polished using a polishing apparatus.

This type of polishing apparatus polishes the peripheral portion of the substrate by bringing a polishing surface of a polishing tape into sliding contact with the peripheral portion of the substrate. In this specification, the peripheral portion is defined as a region including a bevel portion which is the outermost portion of the substrate and a top edge portion and bottom edge portion located radially inwardly of the bevel portion.

FIG. 1A and FIG. 1B are enlarged cross-sectional views each showing a peripheral portion of a substrate. More specifically, FIG. 1A shows a cross-sectional view of a so-called straight-type substrate, and FIG. 1B shows a cross-sectional view of a so-called round-type substrate. In the substrate W shown in FIG. 1A, the bevel portion is an outermost circumferential surface of the substrate W (indicated by a symbol B) that is constituted by an upper slope (an upper bevel portion) P, a lower slope (a lower bevel portion) Q, and a side portion (an apex) R. In the substrate W shown in FIG. 1B, the bevel portion is a portion B having a curved cross section and forming an outermost circumferential surface of the substrate W. The top edge portion is a flat portion E1 located radially inwardly of the bevel portion B and located radially outwardly of a region D where devices are formed. The bottom edge portion is a flat portion E2 located opposite the top edge portion and located radially inwardly of the bevel portion B. These top edge portion E1 and bottom edge portion E2 may be collectively referred to as near-edge portions.

In the conventional polishing apparatus, the polishing tape is pressed by a polishing head against the peripheral portion of the substrate to thereby polish the peripheral portion (for example, see Japanese laid-open patent publication No. 2002-126981). As shown in FIG. 2, when polishing the top edge portion of the substrate, a polishing tape 301 is pressed by a polishing head 300, with the polishing head 300 and the polishing tape 301 inclined.

However, polishing of the peripheral portion of the substrate with the inclined polishing tape results in an oblique edge surface of a device layer, as shown in FIG. 3. The device layer having such an oblique edge surface could raise the following problem in fabrication processes of SOI (Silicon on Insulator) substrate. The SOI substrate is fabricated by sticking a device substrate and a silicon substrate together. More specifically, as shown in FIG. 4A and FIG. 4B, the device substrate W1 and the silicon substrate W2 are stuck together, and then as shown in FIG. 4C, the device substrate W1 is ground from behind by a grinder, whereby the SOI substrate as shown in FIG. 4D is obtained.

Since the device layer has the oblique edge surface, an acute edge is formed as shown in FIG. 4D. Such an acute edge is easily broken, and fragments thereof may be attached as particles to a surface of the device layer. These particles on the device layer would cause defects in devices, thus lowering yield.

The Japanese laid-open patent publication No. 8-97111 discloses a polishing apparatus having a right-angled member that presses a polishing tape against a peripheral portion of a substrate. However, since the polishing tape has a certain thickness and a certain hardness, the polishing tape is not bent at a right angle along the right-angled member in a microscopic level, and the polishing tape is rounded to some degree. As a result, the oblique edge surface is formed on the device layer.

Further, due to a polishing load on the substrate through the polishing tape, the substrate may be bent or the position of the polishing tape may be changed during polishing. As a result, an edge surface of the device layer may be polished obliquely. The Japanese laid-open patent publication No. 2009-208214 discloses a polishing apparatus capable of keeping the substrate in an initial position by balancing a pressing force of a liquid supplied from a periphery supporting mechanism and a pressing force of a polishing mechanism. However, this periphery supporting mechanism is arranged in a position corresponding to the polishing tape and is designed to return the substrate W to its initial position by adjusting their mutual pressing forces when these pressing forces are unbalanced. With this mechanism, the substrate W may not be polished uniformly. As a result, the edge surface of the device layer may not be polished vertically.

SUMMARY OF THE INVENTION

The present invention has been made in view of the above drawback. It is therefore an object of the present invention to provide a polishing apparatus and a polishing method capable of polishing a peripheral portion of a substrate to form a right-angled cross section in the peripheral portion.

One aspect of the present invention for achieving the above object is a polishing apparatus including: a substrate holder configured to hold the substrate and to rotate the substrate; guide rollers configured to support a polishing tape; and a polishing head having a pressing member configured to press an edge of the polishing tape against the peripheral portion of the substrate from above. The guide rollers are arranged such that the polishing tape extends parallel to a tangential direction of the substrate and a polishing surface of the polishing tape is parallel to a surface of the substrate. The substrate holder includes: a holding stage configured to hold the substrate; and a supporting stage configured to support a lower surface of the peripheral portion of the substrate in its entirety held by the holding stage. The supporting stage rotates in unison with the holding stage.

In a preferred aspect of the present invention, the holding stage can move up and down relative to the supporting stage.

Another aspect of the present invention is a polishing apparatus including: a substrate holder configured to hold the substrate and to rotate the substrate; guide rollers configured to support a polishing tape; and a polishing head having a pressing member configured to press an edge of the polishing tape against the peripheral portion of the substrate from above. The guide rollers are arranged such that the polishing tape extends parallel to a tangential direction of the substrate and a polishing surface of the polishing tape is parallel to a surface of the substrate. The polishing head has a tape stopper configured to restrict a horizontal movement of the polishing tape, and the tape stopper is arranged outwardly of the polishing tape with respect to a radial direction of the substrate.

In a preferred aspect of the present invention, the polishing head further has a tape cover arranged in proximity to the polishing surface of the polishing tape.

In a preferred aspect of the present invention, a clearance between the tape cover and the pressing member is larger than a thickness of the polishing tape.

In a preferred aspect of the present invention, the polishing head includes: a projecting member fixed to the pressing member; and a side stopper configured to receive a horizontal movement of the projecting member. The side stopper is arranged outwardly of the projecting member with respect to the radial direction of the substrate.

According to the present invention, the polishing surface of the polishing tape is pressed against the peripheral portion of the substrate from above to thereby polish the top edge portion of the substrate. During polishing of the substrate, the edge of the polishing tape is pressed against the substrate. Therefore, a polished portion can have a right-angled cross-sectional shape.

Further, according to the present invention, the supporting stage that supports the lower surface of the peripheral portion of the substrate can prevent the substrate from being bent. Therefore, the edge of the polishing tape can polish the peripheral portion of the substrate to form a right-angled cross-sectional shape.

Further, according to the present invention, the tape stopper can prevent the polishing tape from moving outwardly of the substrate. Therefore, the edge of the polishing tape can polish the peripheral portion of the substrate to form a right-angled cross-sectional shape.

DETAILED DESCRIPTION OF THE PREFERRED EMBODIMENTS

Embodiments of the present invention will be described below with reference to the drawings.

Figure 5:
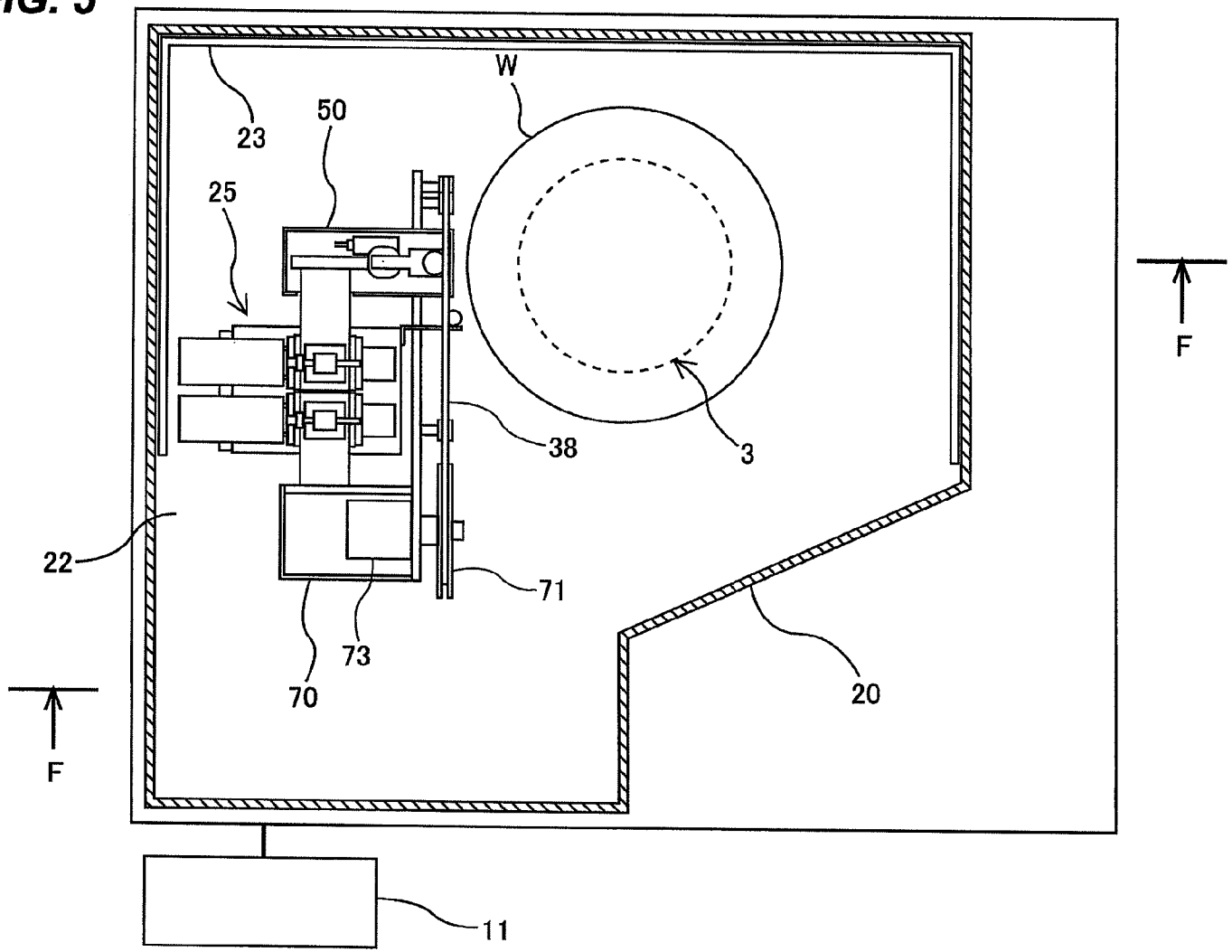
FIG. 5 is a plan view showing a polishing apparatus according to an embodiment of the present invention.
Figure 6:
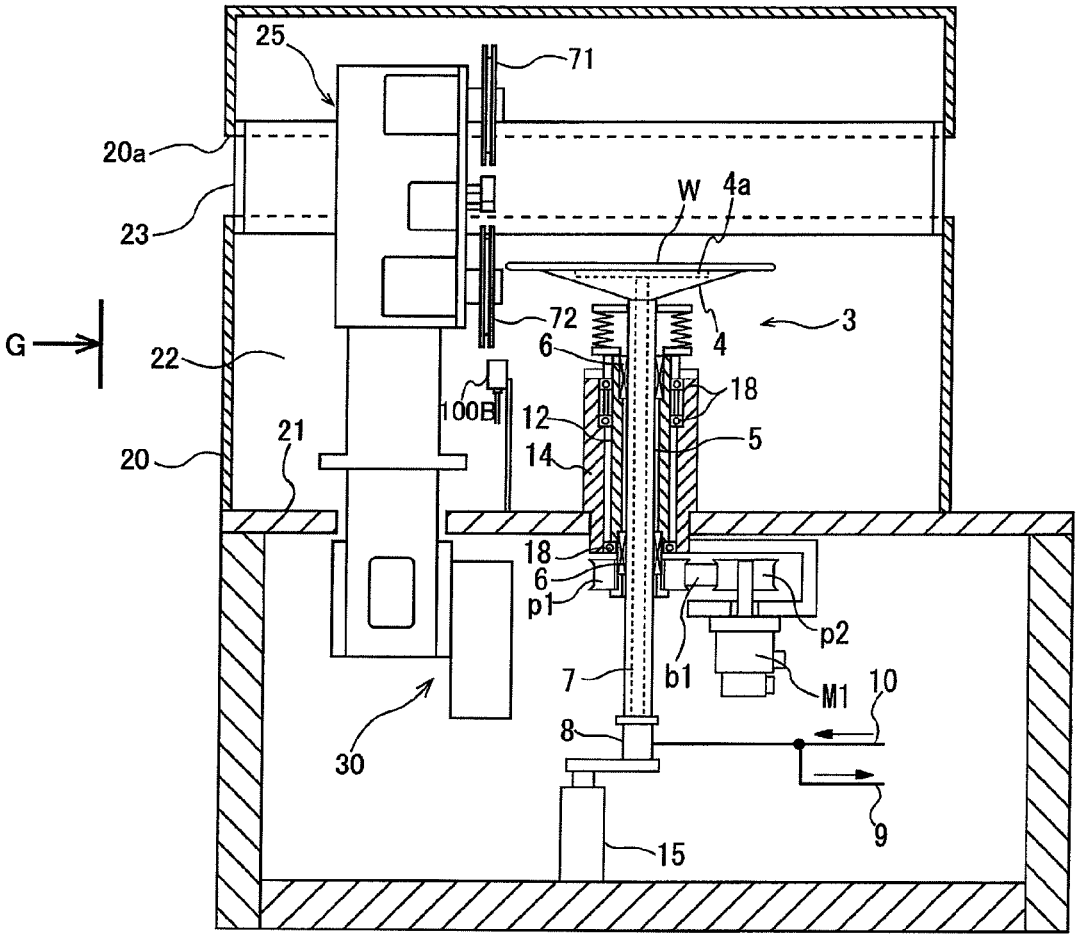
FIG. 6 is a cross-sectional view taken along line F-F in FIG. 5.
Figure 7:
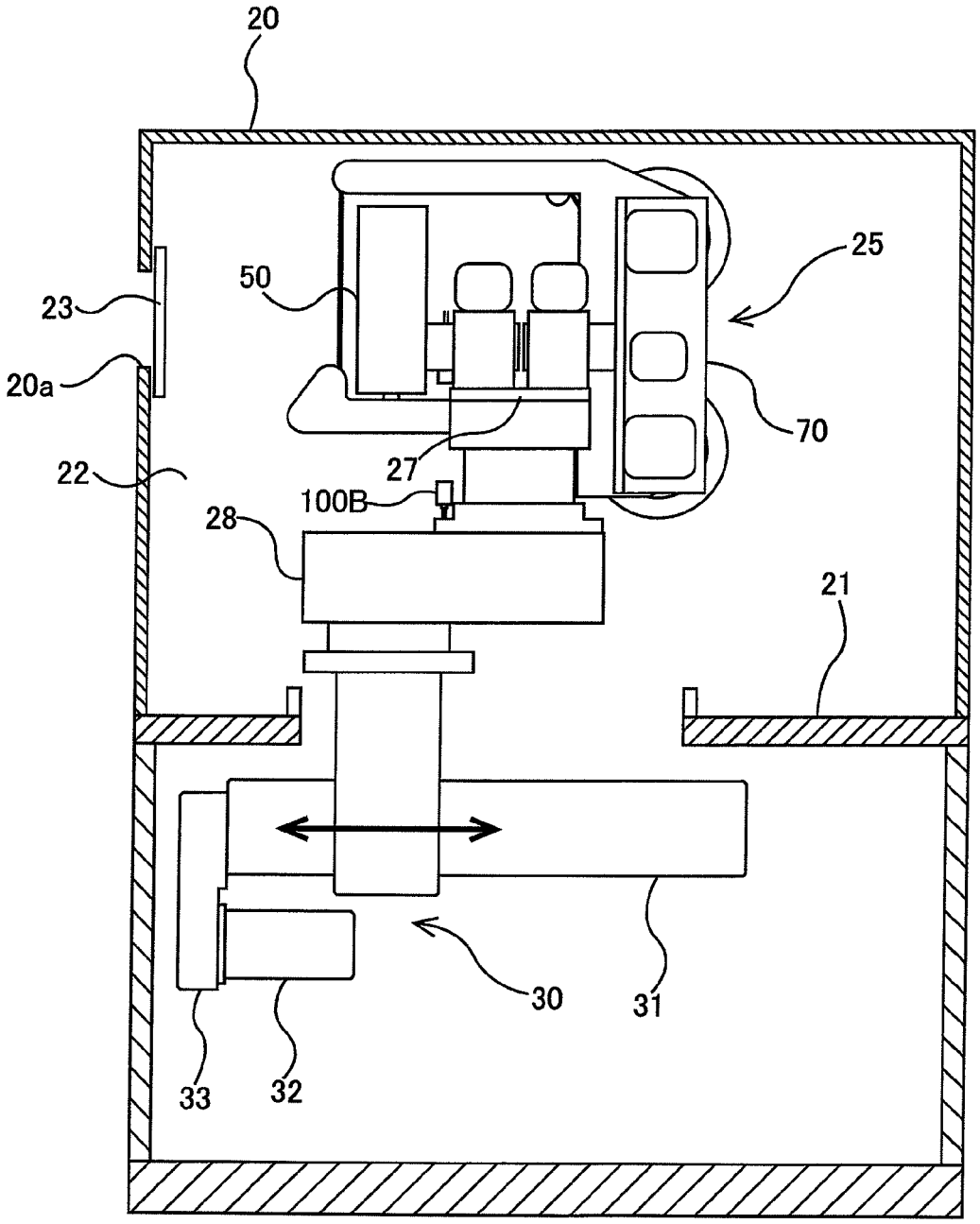
FIG. 7 is a view from a direction indicated by arrow G in FIG. 6.

FIG. 5 is a plan view showing a polishing apparatus according to an embodiment of the present invention, FIG. 6 is a cross-sectional view taken along line F-F in FIG. 5, and FIG. 7 is a view from a direction indicated by arrow G in FIG. 6.

The polishing apparatus according to the embodiment includes a substrate holder 3 configured to hold a substrate W (i.e., a workpiece to be polished) horizontally and to rotate the substrate W. FIG. 5 shows a state in which the substrate holder 3 holds the substrate W. This substrate holder 3 has a holding stage 4 configured to hold a lower surface of the substrate W by a vacuum suction, a hollow shaft 5 coupled to a central portion of the holding stage 4, and a motor M1 for rotating the hollow shaft 5. The substrate W is placed onto the holding stage 4 such that a center of the substrate W is aligned with a central axis of the hollow shaft 5. The holding stage 4 is located in a polishing chamber 22 that is defined by a partition 20 and a base plate 21.

The hollow shaft 5 is supported by ball spline bearings (i.e., linear motion bearings) 6 which allow the hollow shaft 5 to move vertically. The holding stage 4 has an upper surface with grooves 4*a*. These grooves 4*a* communicate with a communication passage 7 extending through the hollow shaft 5. The communication passage 7 is coupled to a vacuum line 9 via a rotary joint 8 provided on a lower end of the hollow shaft 5. The communication passage 7 is also coupled to a nitrogen-gas supply line 10 for use in releasing the substrate W from the holding stage 4 after processing. By selectively coupling the vacuum line 9 and the nitrogen-gas supply line 10 to the communication passage 7, the substrate W can be held on the upper surface of the holding stage 4 by the vacuum suction and can be released from the upper surface of the holding stage 4.

A pulley p1 is coupled to the hollow shaft 5, and a pulley p2 is mounted on a rotational shaft of the motor M1. The hollow shaft 5 is rotated by the motor M1 through the pulley p1, the pulley p2, and a belt b1 riding on these pulleys p1 and p2. The ball spline bearing 6 is a bearing that allows the hollow shaft 5 to move freely in its longitudinal direction. The ball spline bearings 6 are secured to a cylindrical casing 12. Therefore, the hollow shaft 5 can move linearly up and down relative to the casing 12, and the hollow shaft 5 and the casing 12 rotate in unison. The hollow shaft 5 is coupled to an air cylinder (elevating mechanism) 15, so that the hollow shaft 5 and the holding stage 4 are elevated and lowered by the air cylinder 15.

A cylindrical casing 14 is provided so as to surround the casing 12 in a coaxial arrangement. Radial bearings 18 are provided between the casing 12 and the casing 14, so that the casing 12 is rotatably supported by the radial bearings 18. With these structures, the substrate holder 3 can rotate the substrate W about its central axis and can elevate and lower the substrate W along the central axis.

A polishing unit 25 for polishing a peripheral portion of the substrate W is provided radially outwardly of the substrate W held by the substrate holder 3. This polishing unit 25 is located in the polishing chamber 22. As shown in FIG. 7, the polishing unit 25 in its entirety is secured to a mount base 27, which is coupled to a polishing-unit moving mechanism 30 via an arm block 28.

The polishing-unit moving mechanism 30 has a ball screw mechanism 31 that slidably holds the arm block 28, a motor 32 for driving the ball screw mechanism 31, and a power transmission mechanism 33 that couples the ball screw mechanism 31 and the motor 32 to each other. The power transmission mechanism 33 is constructed by pulleys, a belt, and the like. As the motor 32 operates, the ball screw mechanism 31 moves the arm block 28 in directions indicated by arrows in FIG. 7 to thereby move the polishing unit 25 in its entirety in a tangential direction of the substrate W. This polishing-unit moving mechanism 30 also serves as an oscillation mechanism for oscillating the polishing unit 25 at a predetermined amplitude and a predetermined speed.

The polishing unit 25 includes a polishing head 50 for polishing the periphery of the substrate W using a polishing tape 38, and a polishing-tape supply and recovery mechanism 70 for supplying the polishing tape 38 to the polishing head 50 and recovering the polishing tape 38 from the polishing head 50. The polishing head 50 is a top-edge polishing head for polishing the top edge portion of the substrate W by pressing a polishing surface of the polishing tape 38 against the peripheral portion of the substrate W from above.

Figure 8:
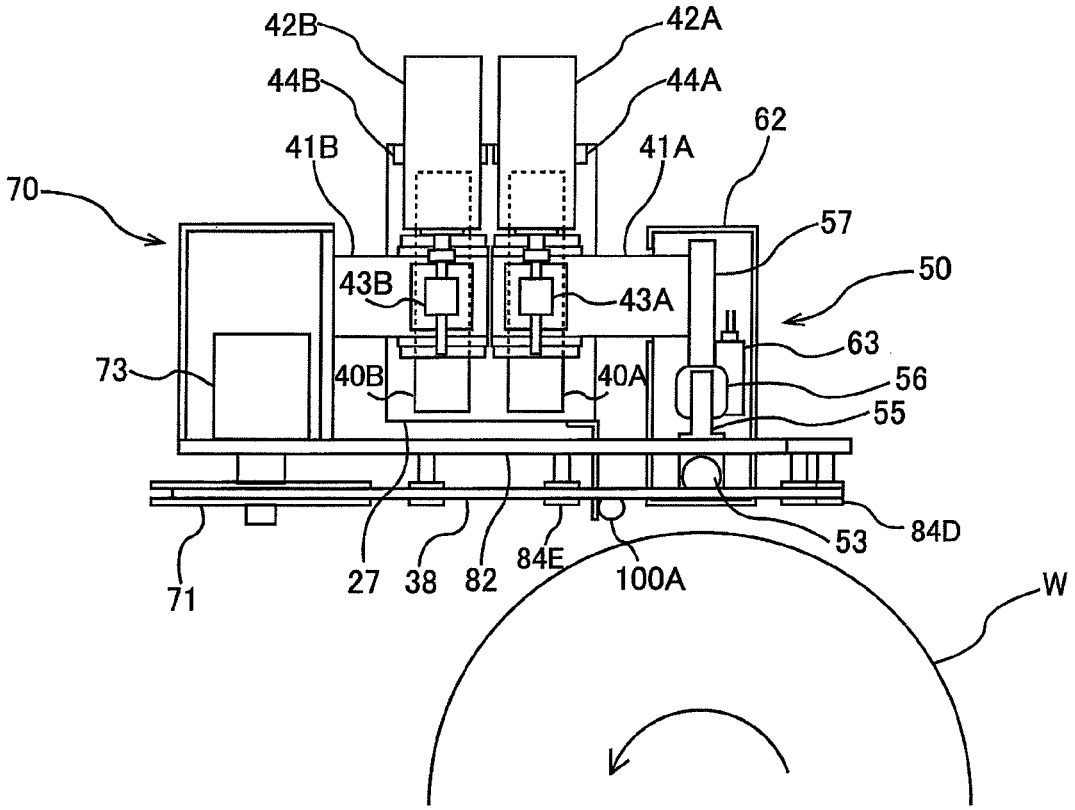
FIG. 8 is a plan view of a polishing head and a polishing-tape supply and recovery mechanism.
Figure 9:
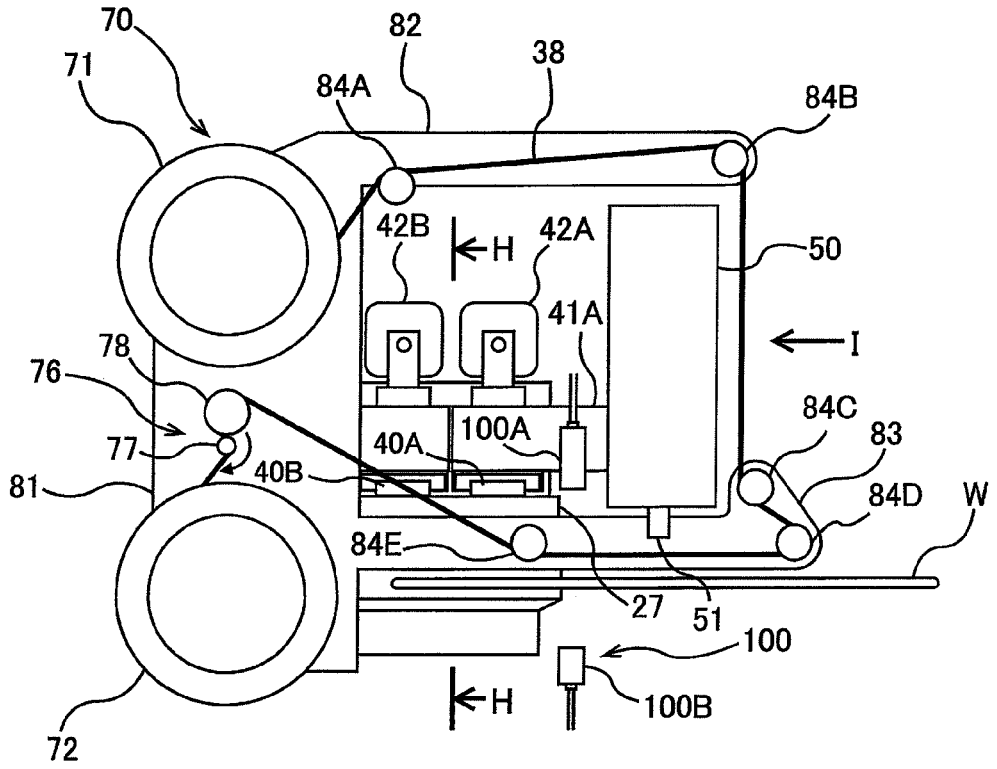
FIG. 9 is a front view of the polishing head and the polishing-tape supply and recovery mechanism.
Figure 10:
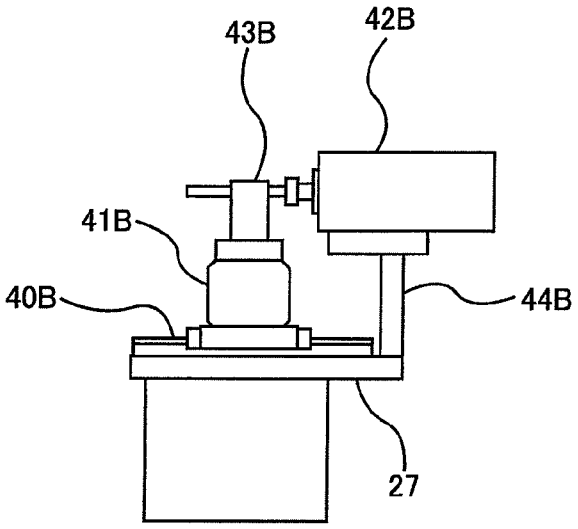
FIG. 10 is a cross-sectional view taken along line H-H in FIG. 9.
Figure 11:
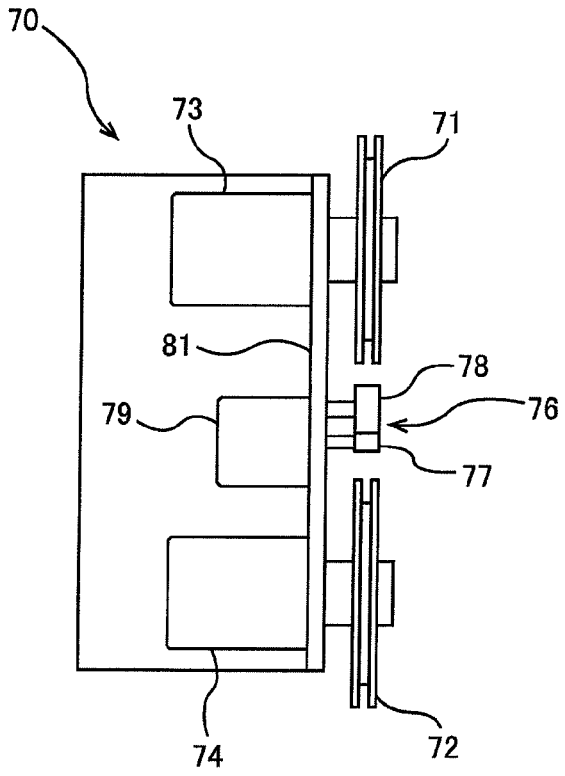
FIG. 11 is a side view of the polishing-tape supply and recovery mechanism shown in FIG. 9.
Figure 12:
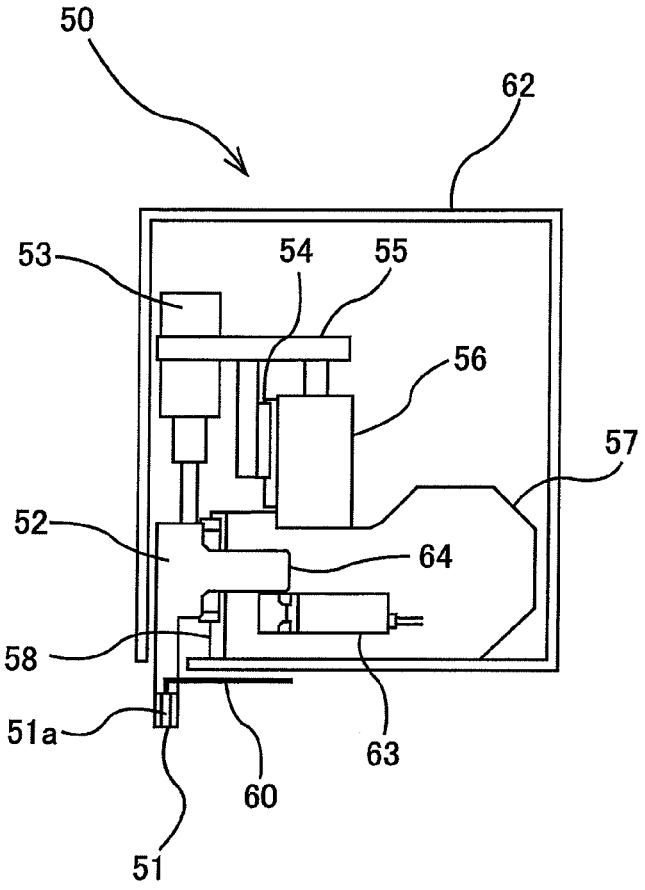
FIG. 12 is a vertical cross-sectional view of the polishing head as viewed from a direction indicated by arrow I in FIG. 9.

FIG. 8 is a plan view of the polishing head 50 and the polishing-tape supply and recovery mechanism 70, FIG. 9 is a front view of the polishing head 50 and the polishing-tape supply and recovery mechanism 70, FIG. 10 is a cross-sectional view taken along line H-H in FIG. 9, FIG. 11 is a side view of the polishing-tape supply and recovery mechanism 70 shown in FIG. 9, and FIG. 12 is a vertical cross-sectional view of the polishing head 50 as viewed from a direction indicated by arrow I in FIG. 9.

Two linear motion guides 40A and 40B, which extend parallel to a radial direction of the substrate W, are disposed on the mount base 27. The polishing head 50 and the linear motion guide 40A are coupled to each other via a coupling block 41A. Further, the polishing head 50 is coupled to a motor 42A and a ball screw 43A for moving the polishing head 50 along the linear motion guide 40A (i.e., in the radial direction of the substrate W). More specifically, the ball screw 43A is secured to the coupling block 41A, and the motor 42A is secured to the mount base 27 through a support member 44A. The motor 42A is configured to rotate a screw shaft of the ball screw 43A, so that the coupling block 41A and the polishing head 50 (which is coupled to the coupling block 41A) are moved along the linear motion guide 40A. The motor 42A, the ball screw 43A, and the linear motion guide 40A constitute a first moving mechanism for moving the polishing head 50 in the radial direction of the substrate W held on the substrate holder 3.

Similarly, the polishing-tape supply and recovery mechanism 70 and the linear motion guide 40B are coupled to each other via a coupling block 41B. Further, the polishing-tape supply and recovery mechanism 70 is coupled to a motor 42B and a ball screw 43B for moving the polishing-tape supply and recovery mechanism 70 along the linear motion guide 40B (i.e., in the radial direction of the substrate W). More specifically, the ball screw 43B is secured to the coupling block 41B, and the motor 42B is secured to the mount base 27 through a support member 44B. The motor 42B is configured to rotate a screw shaft of the ball screw 43B, so that the coupling block 41B and the polishing-tape supply and recovery mechanism 70 (which is coupled to the coupling block 41B) are moved along the linear motion guide 40B. The motor 42B, the ball screw 43B, and the linear motion guide 40B constitute a second moving mechanism for moving the polishing-tape supply and recovery mechanism 70 in the radial direction of the substrate W held on the substrate holder 3.

As shown in FIG. 12, the polishing head 50 has a pressing member 51 for pressing the polishing tape 38 against the substrate W, a pressing-member holder 52 that holds the pressing member 51, and an air cylinder 53 as an actuator configured to push down the pressing-member holder 52 (and the pressing member 51). The air cylinder 53 is held by a holding member 55. Further, the holding member 55 is coupled to an air cylinder 56 serving as a lifter via a linear motion guide 54 extending in a vertical direction. As a gas (e.g., air) is supplied to the air cylinder 56 from a non-illustrated gas supply source, the air cylinder 56 pushes up the holding member 55, whereby the holding member 55, the air cylinder 53, the pressing-member holder 52, and the pressing member 51 are elevated along the linear motion guide 54.

The air cylinder 56 is secured to a mount member 57 that is fixed to the coupling block 41A. The mount member 57 and the pressing-member holder 52 are coupled to each other via a linear motion guide 58 extending in the vertical direction. When the pressing-member holder 52 is pushed down by the air cylinder 53, the pressing member 51 is moved downward along the linear motion guide 58 to thereby press the polishing tape 38 against the peripheral portion of the substrate W. The pressing member 51 is made of resin (e.g., PEEK (polyetheretherketone)), metal (e.g., stainless steel), or ceramic (e.g., SiC (silicon carbide)).

The pressing member 51 has through-holes 51*a* extending in the vertical direction. A vacuum line 60 is coupled to the through-holes 51*a*. This vacuum line 60 has a valve (not shown in the drawings) therein. By opening this valve, a vacuum is produced in the through-holes 51*a* of the pressing member 51. When the vacuum is produced in the through-holes 51*a* with the pressing member 51 in contact with an upper surface of the polishing tape 38, this upper surface of the polishing tape 38 is held on a lower surface of the pressing member 51. Only one through-hole 51*a* may be provided in the pressing member 51.

The pressing-member holder 52, the air cylinder 53, the holding member 55, the air cylinder 56, and the mount member 57 are housed in a box 62. A lower portion of the pressing-member holder 52 projects from a bottom of the box 62, and the pressing member 51 is attached to this lower portion of the pressing-member holder 52. A position sensor 63 for detecting a vertical position of the pressing member 51 is disposed in the box 62. This position sensor 63 is mounted to the mount member 57. A dog 64, which serves as a sensor target, is provided on the pressing-member holder 52. The position sensor 63 is configured to detect the vertical position of the pressing member 51 based on the vertical position of the dog 64.

Figure 13:
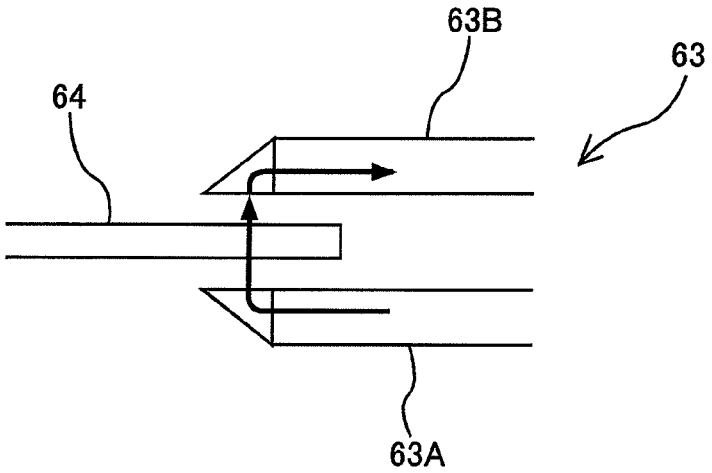
FIG. 13 is a view of a position sensor and a dog as viewed from above.

FIG. 13 is a view of the position sensor 63 and the dog 64 as viewed from above. The position sensor 63 has a light emitter 63A and a light receiver 63B. When the dog 64 is lowered together with the pressing-member holder 52 (and the pressing member 51), a part of light emitted from the light emitter 63A is interrupted by the dog 64. Therefore, the position of the dog 64, i.e., the vertical position of the pressing member 51, can be detected from a quantity of the light received by the light receiver 63B. The position sensor 63 shown in FIG. 13 is a so-called transmission optical sensor. However, other type of position sensor may be used.

The polishing-tape supply and recovery mechanism 70 has a supply reel 71 for supplying the polishing tape 38 and a recovery reel 72 for recovering the polishing tape 38. The supply reel 71 and the recovery reel 72 are coupled to tension motors 73 and 74, respectively. These tension motors 73 and 74 are configured to apply predetermined torque to the supply reel 71 and the recovery reel 72 to thereby exert a predetermined tension on the polishing tape 38.

A polishing-tape sending mechanism 76 is provided between the supply reel 71 and the recovery reel 72. This polishing-tape sending mechanism 76 has a tape-sending roller 77 for sending the polishing tape 38, a nip roller 78 that presses the polishing tape 38 against the tape-sending roller 77, and a tape-sending motor 79 for rotating the tape-sending roller 77. The polishing tape 38 is interposed between the tape-sending roller 77 and the nip roller 78. By rotating the tape-sending roller 77 in a direction indicated by arrow in FIG. 9, the polishing tape 38 is sent from the supply reel 71 to the recovery reel 72.

The tension motors 73 and 74 and the tape-sending motor 79 are mounted on a pedestal 81. This pedestal 81 is secured to the coupling block 41B. The pedestal 81 has two support arms 82 and 83 extending from the supply reel 71 and the recovery reel 72 toward the polishing head 50. A plurality of guide rollers 84A, 84B, 84C, 84D, and 84E for supporting the polishing tape 38 are provided on the support arms 82 and 83. The polishing tape 38 is guided by these guide rollers 84A to 84E so as to surround the polishing head 50.

The extending direction of the polishing tape 38 is perpendicular to the radial direction of the substrate W as viewed from above. The two guide rollers 84D and 84E, which are located below the polishing head 50, support the polishing tape 38 such that the polishing surface of the polishing tape 38 is parallel to the surface (upper surface) of the substrate W. Further, the polishing tape 38 extending between these guide rollers 84D and 84E is parallel to the tangential direction of the substrate W. There is a clearance in the vertical direction between the polishing tape 38 and the substrate W.

The polishing apparatus further has a tape-edge detection sensor 100 for detecting a position of an edge of the polishing tape 38. This tape-edge detection sensor 100 is a transmission optical sensor, as well as the above-described position sensor 63. The tape-edge detection sensor 100 has a light emitter 100A and a light receiver 100B. The light emitter 100A is secured to the mount base 27 as shown in FIG. 8, and the light receiver 100B is secured to the base plate 21 that defines the polishing chamber 22 as shown in FIG. 6. This tape-edge detection sensor 100 is configured to detect the position of the edge of the polishing tape 38 based on a quantity of the light received by the light receiver 100B.

Figure 14:
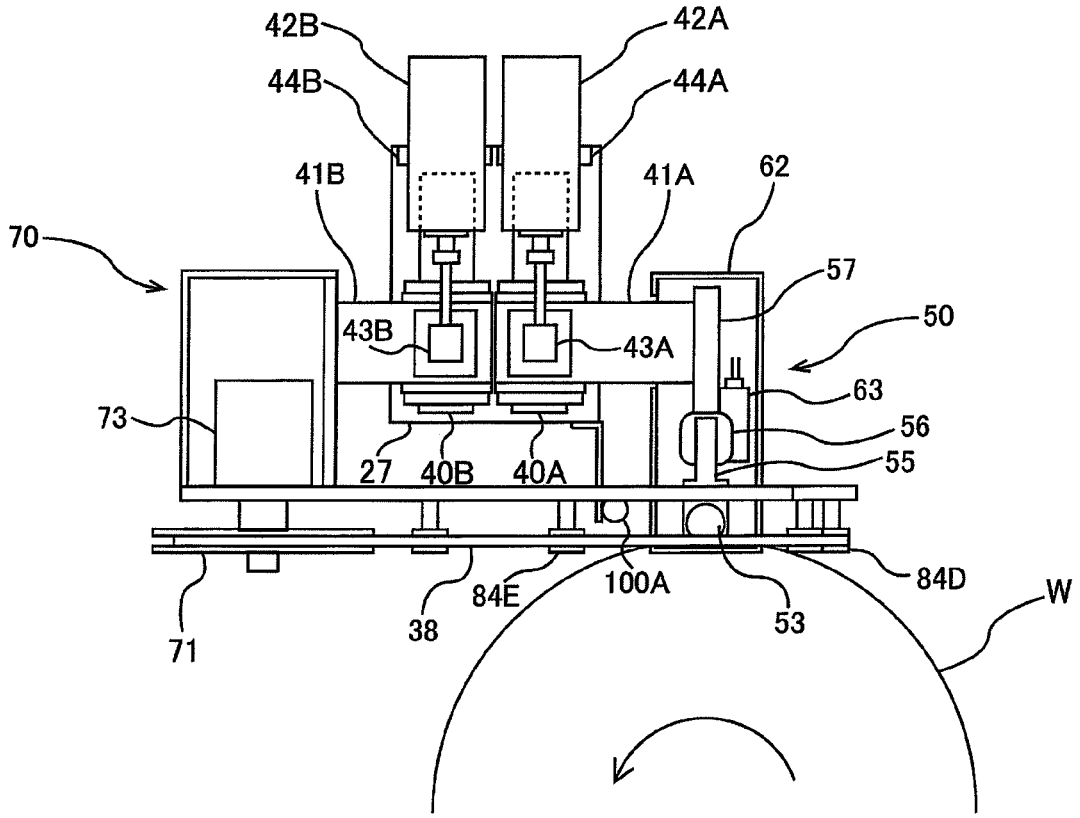
FIG. 14 is a view of the polishing head and the polishing-tape supply and recovery mechanism moved to predetermined polishing positions.
Figure 15:
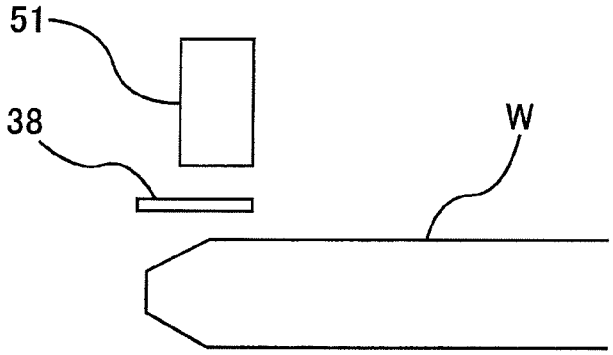
FIG. 15 is a schematic view of a pressing member, a polishing tape, and a substrate at the polishing positions as viewed from a lateral direction.
Figure 16:
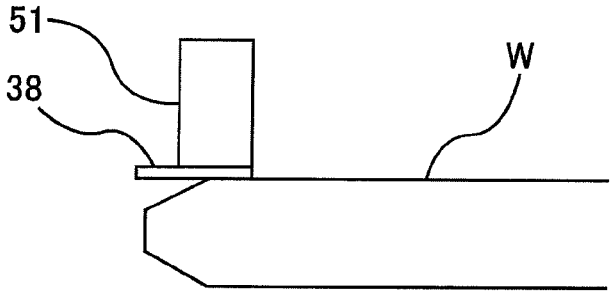
FIG. 16 is a view showing a state in which the pressing member is pressing the polishing tape against the substrate.

As shown in FIG. 14, when polishing the substrate W, the polishing head 50 and the polishing-tape supply and recovery mechanism 70 are moved to their predetermined polishing positions, respectively, by the motors 42A and 42B and the ball screws 43A and 43B. The polishing tape 38 at the polishing position extends in the tangential direction of the substrate W. FIG. 15 is a schematic view of the pressing member 51, the polishing tape 38, and the substrate W at the polishing positions as viewed from the lateral direction. As shown in FIG. 15, the polishing tape 38 is located above the peripheral portion of the substrate W, and the pressing member 51 is located above the polishing tape 38. FIG. 16 is a view showing a state in which the pressing member 51 is pressing the polishing tape 38 against the substrate W. As shown in FIG. 16, the edge of the pressing member 51 and the edge of the polishing tape 38 at their polishing positions coincide with each other. That is, the polishing head 50 and the polishing-tape supply and recovery mechanism 70 are moved independently to their respective polishing positions such that the edge of the pressing member 51 and the edge of the polishing tape 38 coincide with each other.

Next, polishing operations of the polishing apparatus having the above-described structures will be described. The following operations of the polishing apparatus are controlled by an operation controller 11 shown in FIG. 5. The substrate W is held by the substrate holder 3 such that a film (e.g., a device layer) formed on the surface thereof faces upward, and further the substrate W is rotated about its center. Liquid (e.g., pure water) is supplied to the center of the rotating substrate W from a liquid supply mechanism (not shown in the drawings). The pressing member 51 of the polishing head 50 and the polishing tape 38 are moved to the predetermined polishing positions, respectively, as shown in FIG. 15.

Figure 17A:
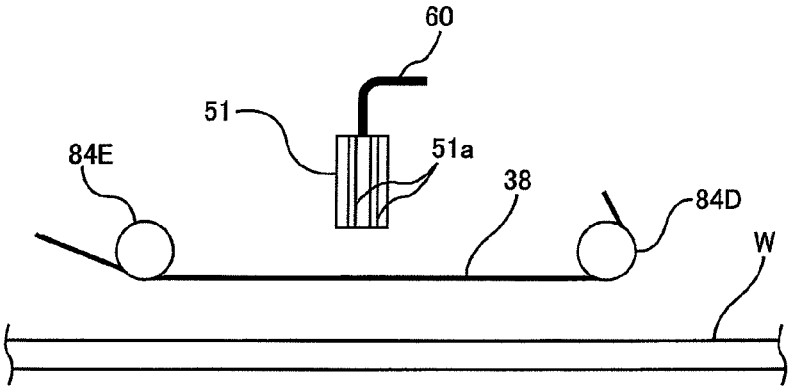
FIG. 17A is a view of the polishing tape and the pressing member at the polishing positions as viewed from a radial direction of the substrate.
Figure 17B:
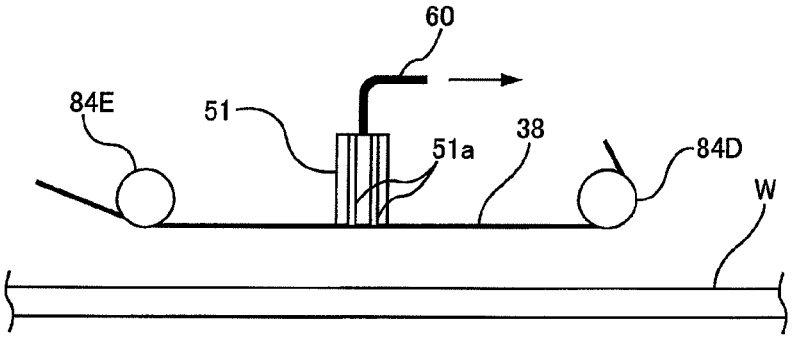
FIG. 17B is a view showing a state in which a lower surface of the pressing member is in contact with an upper surface of the polishing tape.
Figure 17C:
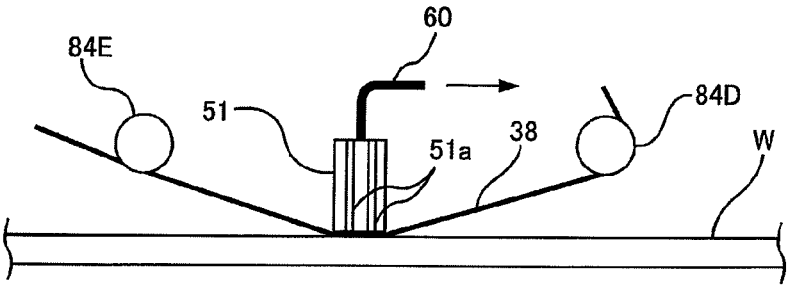
FIG. 17C is a view showing a state in which the pressing member is pressing the polishing tape against the substrate from above.

FIG. 17A is a view of the polishing tape 38 and the pressing member 51 at the polishing positions as viewed from the radial direction of the substrate W. The pressing member 51 shown in FIG. 17A is in an upper position as a result of being elevated by the air cylinder 56 (see FIG. 12). In this position, the pressing member 51 is located above the polishing tape 38. Subsequently, the operation of the air cylinder 56 is stopped and as a result a piston rod thereof is lowered. The pressing member 51 is lowered until its lower surface contacts the upper surface of the polishing tape 38 as shown in FIG. 17B. In this state, the vacuum is produced in the through-holes 51*a* of the pressing member 51 through the vacuum line 60 to enable the lower surface of the pressing member 51 to hold the polishing tape 38. While holding the polishing tape 38, the pressing member 51 is lowered by the air cylinder 53 (see FIG. 12) to press the polishing surface of the polishing tape 38 against the peripheral portion of the substrate W at a predetermined polishing load, as shown in FIG. 17C. The polishing load can be adjusted by the pressure of the gas supplied to the air cylinder 53.

The peripheral portion of the substrate W is polished by the sliding contact between the rotating substrate W and the polishing tape 38. In order to increase a polishing rate of the substrate W, the polishing tape 38 may be oscillated in the tangential direction of the substrate W by the polishing-unit moving mechanism 30 during polishing of the substrate W. During polishing, the liquid (e.g., pure water) is supplied onto the center of the rotating substrate W, so that the substrate W is polished in the presence of the water. The liquid, supplied to the substrate W, spreads over the upper surface of the substrate W in its entirety via a centrifugal force. This liquid can prevent polishing debris from contacting devices of the substrate W formed thereon. As described above, during polishing, the polishing tape 38 is held on the pressing member 51 by the vacuum suction. Therefore, a relative change in position between the polishing tape 38 and the pressing member 51 is prevented. As a result, a polishing position and a polishing profile can be stable. Further, even when the polishing load is increased, the relative position between the polishing tape 38 and the pressing member 51 does not change. Therefore, a polishing time can be shortened.

Figure 1A:
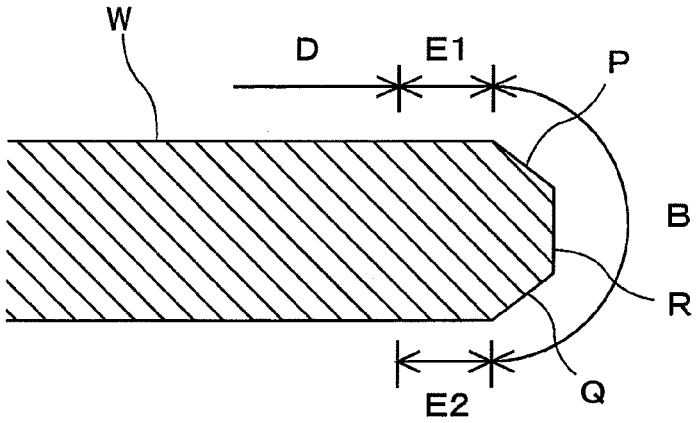
FIG. 1A and FIG. 1B are views each showing a peripheral portion of a substrate.
Figure 1B:
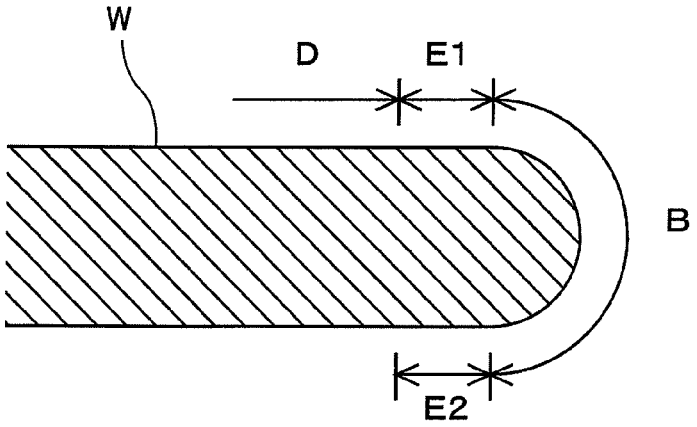
Figure 2:
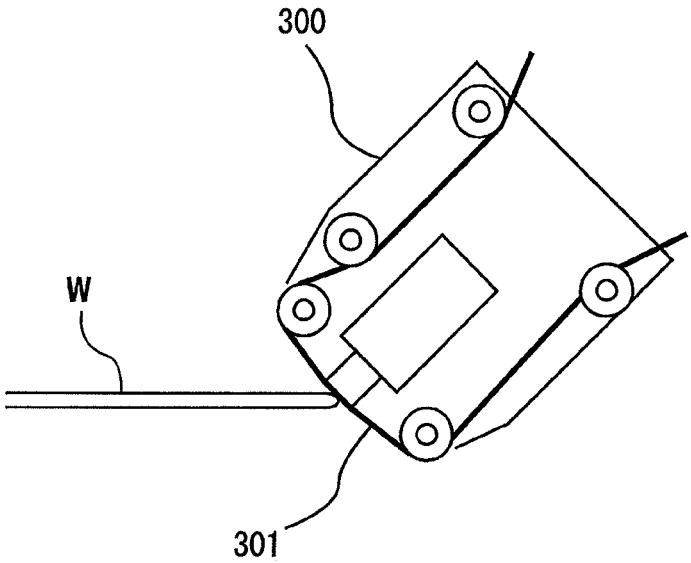
FIG. 2 is a schematic view showing a conventional method of polishing the peripheral portion of the substrate.
Figure 3:
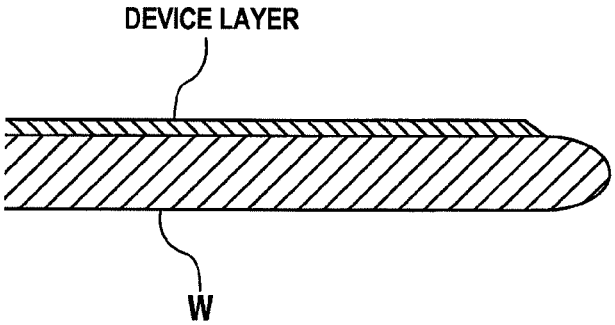
FIG. 3 is a cross-sectional view of the substrate polished by the method shown in FIG. 2.
Figure 4A:
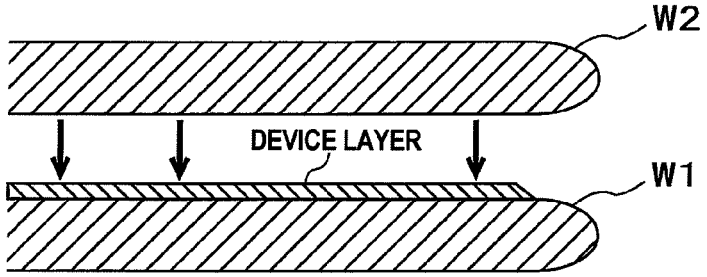
FIG. 4A through FIG. 4D are views illustrating fabrication processes of an SOI substrate.
Figure 4B:
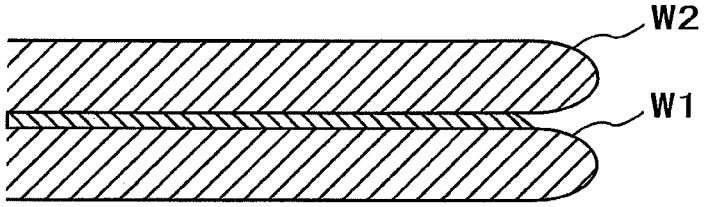
Figure 4C:
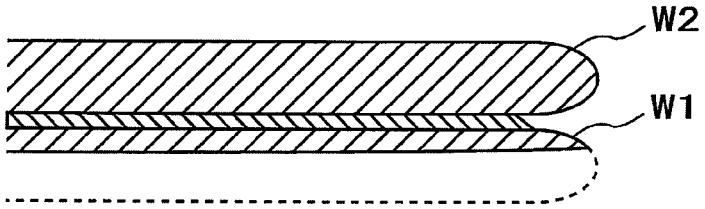
Figure 4D:
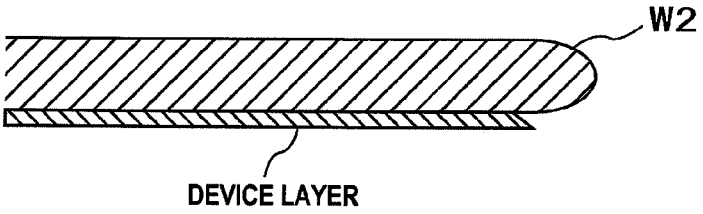
Figure 18:
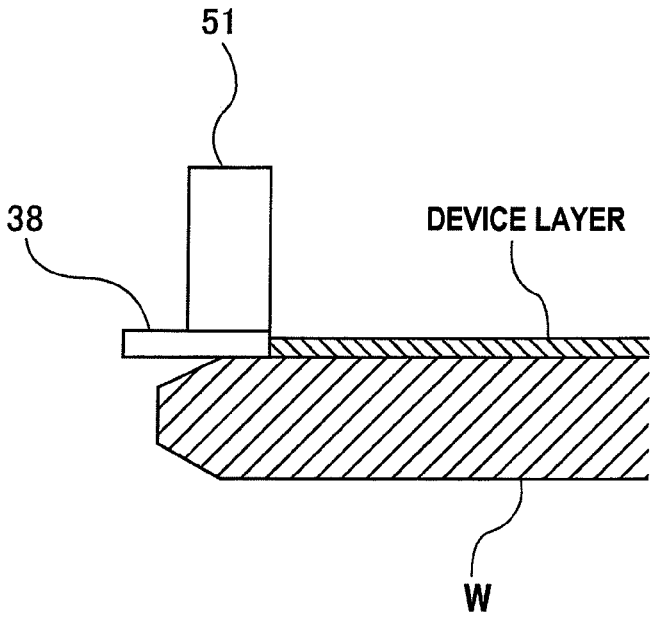
FIG. 18 is an enlarged view showing the peripheral portion of the substrate when being polished by the polishing tape.
Figure 19:
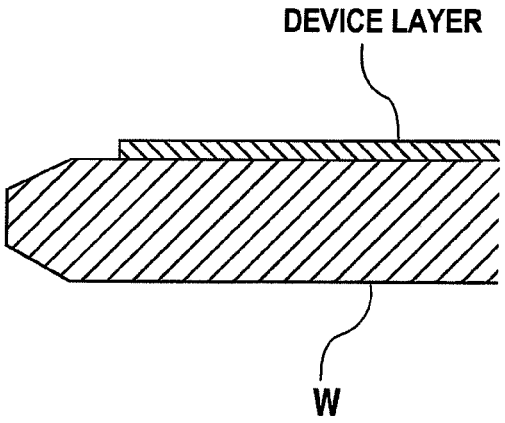
FIG. 19 is a cross-sectional view showing a cross-sectional shape of the peripheral portion of the polished substrate.

Because the polishing tape 38 is pressed from above by the pressing member 51, the polishing tape 38 can polish the top edge portion of the substrate W (see FIG. 1A and FIG. 1B). FIG. 18 is an enlarged view showing the peripheral portion of the substrate W when being polished by the polishing tape 38. As shown in FIG. 18, a flat portion, including the edge, of the polishing tape 38 is pressed against the peripheral portion of the substrate W, with the edge of the polishing tape 38 and the edge of the pressing member 51 coinciding with each other. The edge of the polishing tape 38 is a right-angled corner. This right-angled edge of the polishing tape 38 is pressed against the peripheral portion of the substrate W from above by the edge of the pressing member 51. Therefore, as shown in FIG. 19, the polished substrate W can have a right-angled cross-sectional shape. That is, the device layer can have the edge surface perpendicular to the surface of the substrate W.

The vertical position of the pressing member 51 during polishing of the substrate W is detected by the position sensor 63. Therefore, a polishing end point can be detected from the vertical position of the pressing member 51. For example, polishing of the peripheral portion of the substrate W can be terminated when the vertical position of the pressing member 51 has reached a predetermined target position. This target position is determined according to a target amount of polishing.

When polishing of the substrate W is terminated, supply of the gas to the air cylinder 53 is stopped, whereby the pressing member 51 is elevated to the position shown in FIG. 17B. At the same time, the vacuum suction of the polishing tape 38 is stopped. Further, the pressing member 51 is elevated by the air cylinder 56 to the position shown in FIG. 17A. The polishing head 50 and the polishing-tape supply and recovery mechanism 70 are moved to the retreat positions shown in FIG. 8. The polished substrate W is elevated by the substrate holder 3 and transported to the exterior of the polishing chamber 22 by hands of a non-illustrated transporting mechanism. Before polishing of the next substrate is started, the polishing tape 38 is sent from the supply reel 71 to the recovery reel 72 by a predetermined distance by the tape-sending mechanism 76, so that a new polishing surface is used for polishing of the next substrate. When the polishing tape 38 is estimated to be clogged with the polishing debris, the polished substrate W may be polished again with the new polishing surface after the polishing tape 38 is sent by the predetermined distance. Clogging of the polishing tape 38 can be estimated from, for example, the polishing time and the polishing load. Polishing of the substrate W may be performed while sending the polishing tape 38 at a predetermined speed by the tape-sending mechanism 76. In this case, it is not necessary to hold the polishing tape 38 by the vacuum suction. Further, it is possible to send the polishing tape 38 by the polishing-tape sending mechanism 76 while holding the polishing tape 38 by the vacuum suction.

The polishing tape 38 is a long and narrow strip-shaped polishing tool. Although a width of the polishing tape 38 is basically constant throughout its entire length, there may be a slight variation in the width of the polishing tape 38 in some parts thereof. As a result, the position of the edge of the polishing tape 38 at its polishing position may vary from substrate to substrate. On the other hand, the position of the pressing member 51 at its polishing position is constant at all times. Thus, in order to enable the edge of the polishing tape 38 to coincide with the edge of the pressing member 51, the position of the edge of the polishing tape 38 is detected by the above-described tape-edge detection sensor 100 before the polishing tape 38 is moved to its polishing position.

Figure 20A:
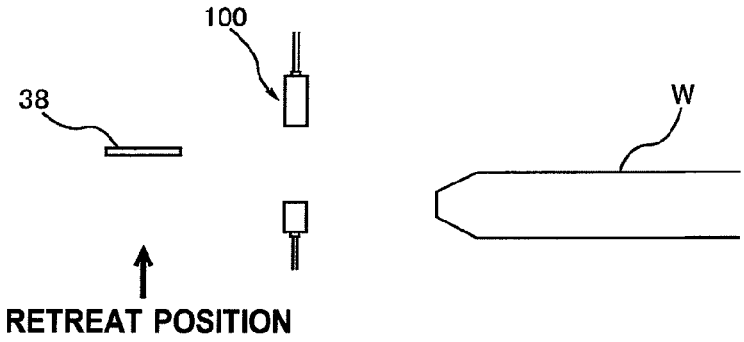
FIG. 20A through FIG. 20C are views illustrating operations for detecting an edge of the polishing tape.
Figure 20B:
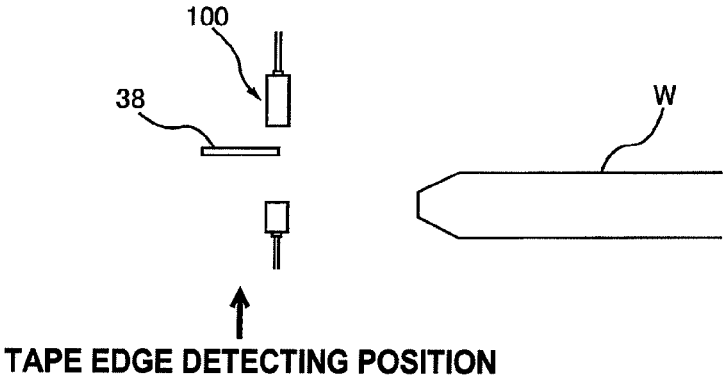
Figure 20C:
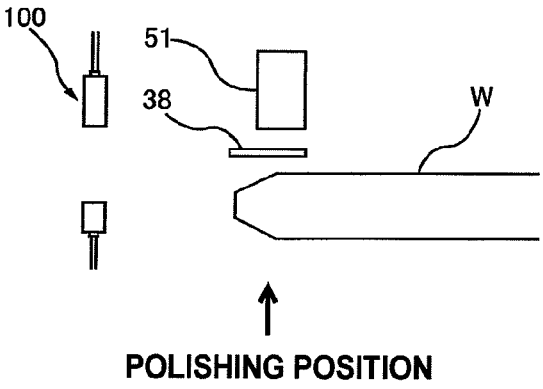

FIG. 20A through FIG. 20C are views illustrating operations for detecting the edge of the polishing tape 38. Prior to polishing of the substrate W, the polishing tape 38 is moved from a retreat position shown in FIG. 20A to a tape-edge detecting position shown in FIG. 20B. In this tape-edge detecting position, the position of the substrate-side edge of the polishing tape 38 is detected by the tape-edge detection sensor 100. Then, as shown in FIG. 20C, the polishing tape 38 is moved to the polishing position such that the edge of the polishing tape 38 coincides with the edge of the pressing member 51. Because the polishing tape 38 is movable independently of the polishing head 50, the polishing tape 38 can be moved by a distance that can vary depending on the width of the polishing tape 38.

The position of the edge of the pressing member 51 at the polishing position is stored in advance in the operation controller 11 (see FIG. 5). Therefore, the operation controller 11 can calculate the travel distance of the polishing tape 38 for allowing the edge of the polishing tape 38 to coincide with the edge of the pressing member 51 from the detected edge position of the polishing tape 38 and the edge position of the pressing member 51. In this manner, the travel distance of the polishing tape 38 is determined based on the detected position of the edge of the polishing tape 38. Therefore, the edge of the polishing tape 38 can be aligned with the edge of the pressing member 51. As a result, the edge of the polishing tape 38 can form the right-angled cross-sectional shape in the substrate W.

Figure 21:
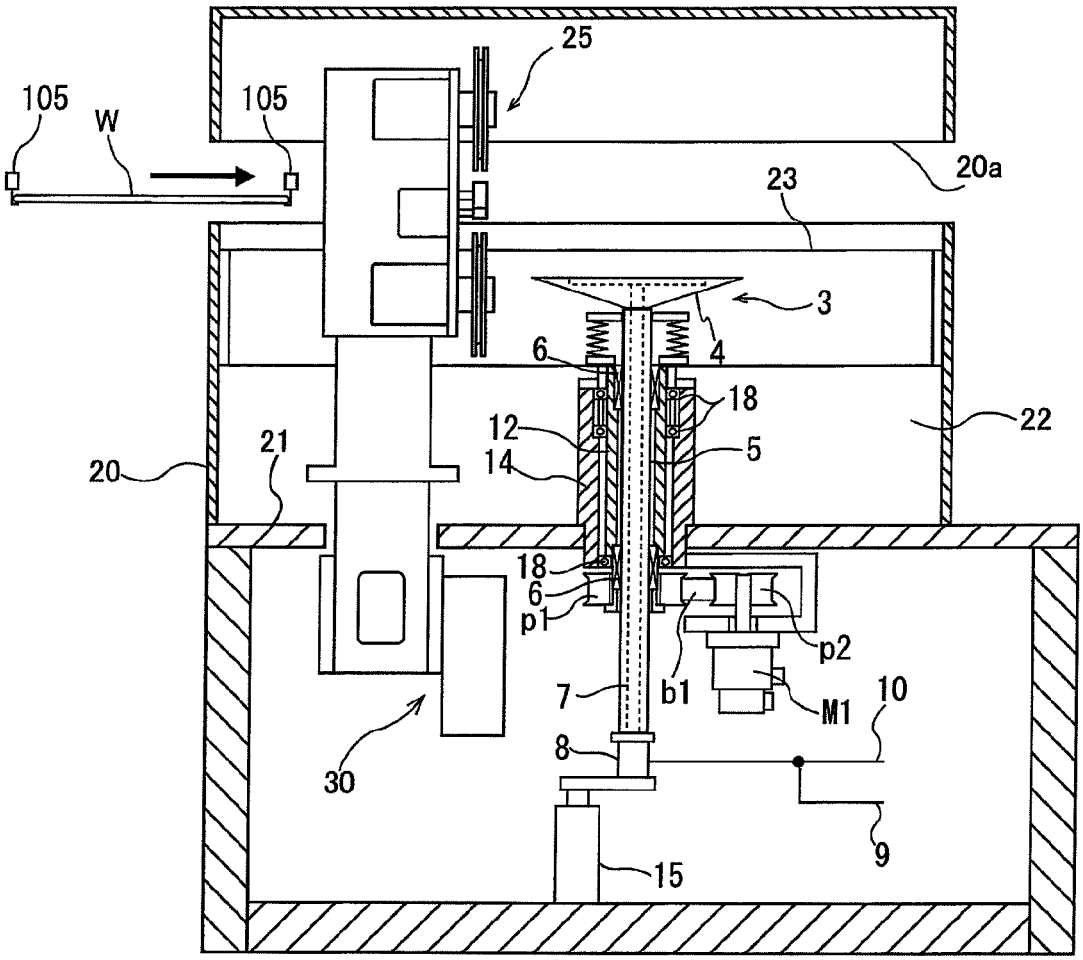
FIG. 21 is a view showing a manner in which the substrate is transported into the polishing apparatus.
Figure 22:
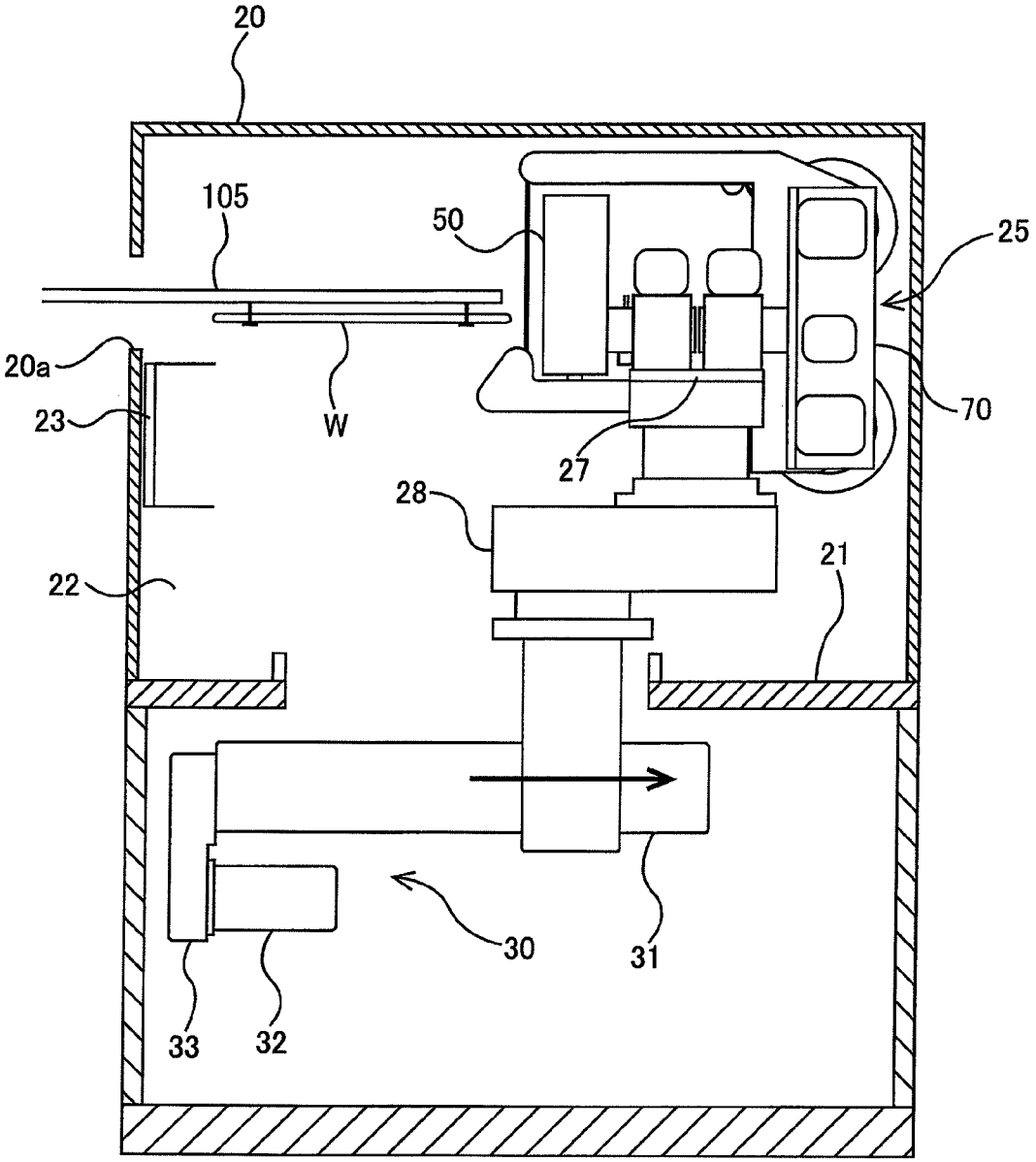
FIG. 22 is a view showing a manner in which a polishing unit is moved to a retreat position.

As shown in FIG. 5 through FIG. 7, the partition 20 has an entrance 20*a* through which the substrate W is transported into and removed from the polishing room 22. The entrance 20*a* is in the form of a horizontally extending cutout. This entrance 20*a* can be closed by a shutter 23. As shown in FIG. 21, the substrate W to be polished is transported into the polishing chamber 22 through the entrance 20*a* by hands 105 of a transporting mechanism, with the shutter 23 opened. As shown in FIG. 22, the polishing unit 25 is moved to the retreat position by the above-described polishing-unit moving mechanism 30 so that the substrate W does not bump into the polishing unit 25.

Figure 23:
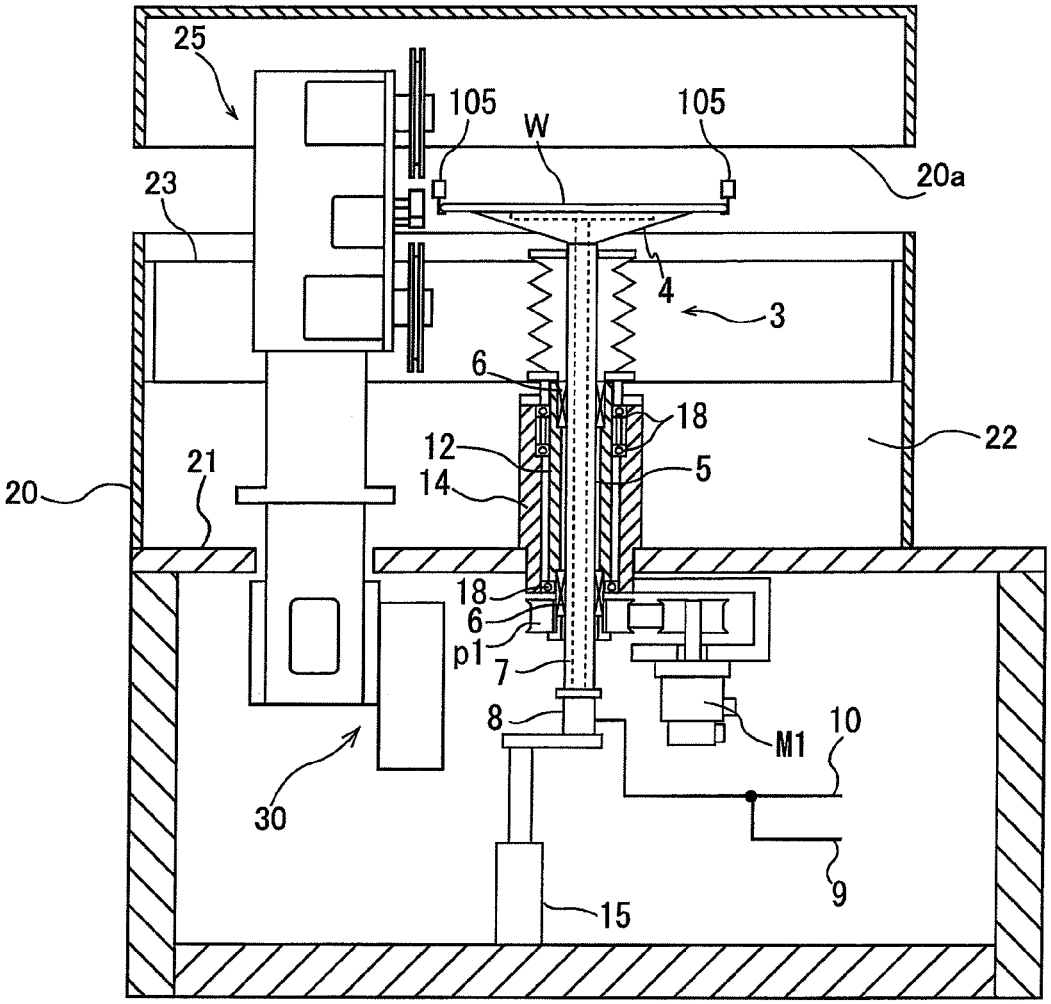
FIG. 23 is a view showing a manner in which the substrate is held by a holding stage.

After the substrate W is transported into the polishing chamber 22, the air cylinder 15 elevates the holding stage 4 as shown in FIG. 23, so that the substrate W is held on the upper surface of the holding stage 4. Thereafter, the holding stage 4 is lowered, together with the substrate W, to the predetermined polishing position. FIG. 6 shows that the substrate W is in the polishing position. Then the polishing unit 25 is moved from the retreat position shown in FIG. 22 to the substrate polishing position shown in FIG. 7, and polishes the substrate W in a manner as described above. During polishing of the substrate W, the entrance 20*a* is closed by the shutter 23.

Figure 24:
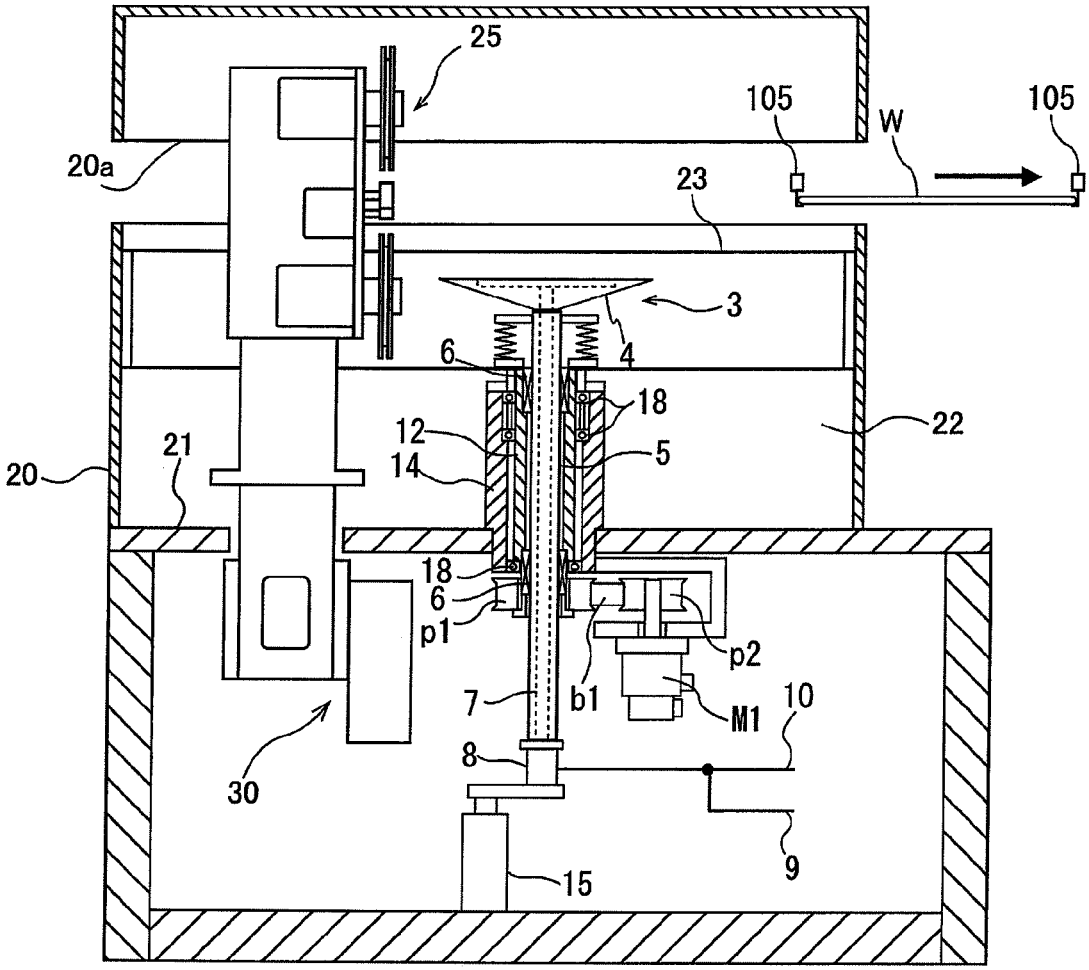
FIG. 24 is a view showing a manner in which the substrate is removed from the polishing apparatus.

After polishing of the substrate W is completed, the polishing unit 25 is moved to the retreat position shown in FIG. 22 again by the above-described polishing-unit moving mechanism 30. Thereafter, the hands 105 enter the polishing chamber 22. Further, the holding stage 4, together with the substrate W, is elevated again to a substrate transfer position shown in FIG. 23. The hands 105 grasp the substrate W and remove the substrate W from the polishing chamber 22 as shown in FIG. 24. In this manner, the substrate W, held by the hands 105, can travel across the polishing chamber 22 through the entrance 20*a* while keeping its horizontal position.

Figure 25:
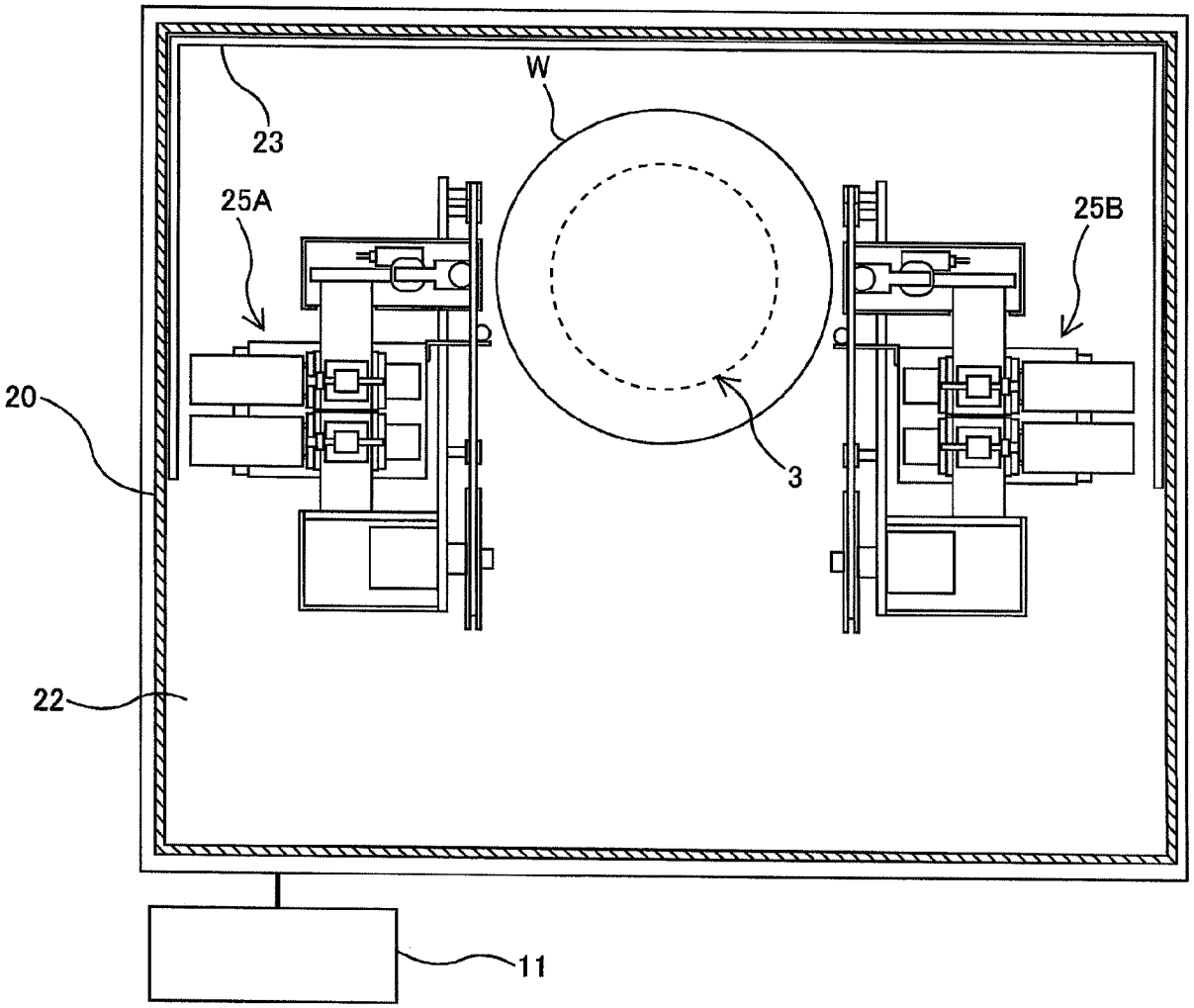
FIG. 25 is a plan view showing the polishing apparatus having multiple polishing units.

FIG. 25 is a plan view showing the polishing apparatus having multiple polishing units with the above-discussed structures. In this polishing apparatus, a first polishing unit 25A and a second polishing unit 25B are provided in the polishing chamber 22. These polishing units 25A and 25B are symmetrical about the substrate W held by the substrate holder 3. The first polishing unit 25A is movable by a first polishing-unit moving mechanism (not shown in the drawings), and the second polishing unit 25B is movable by a second polishing-unit moving mechanism (not shown in the drawings). These first and second polishing-unit moving mechanisms have the same structures as those of the above-described polishing-unit moving mechanism 30.

Different types of polishing tapes can be used in the first polishing unit 25A and the second polishing unit 25B. For example, rough polishing may be performed in the first polishing unit 25A and finish polishing may be performed in the second polishing unit 25B.

Figure 26:
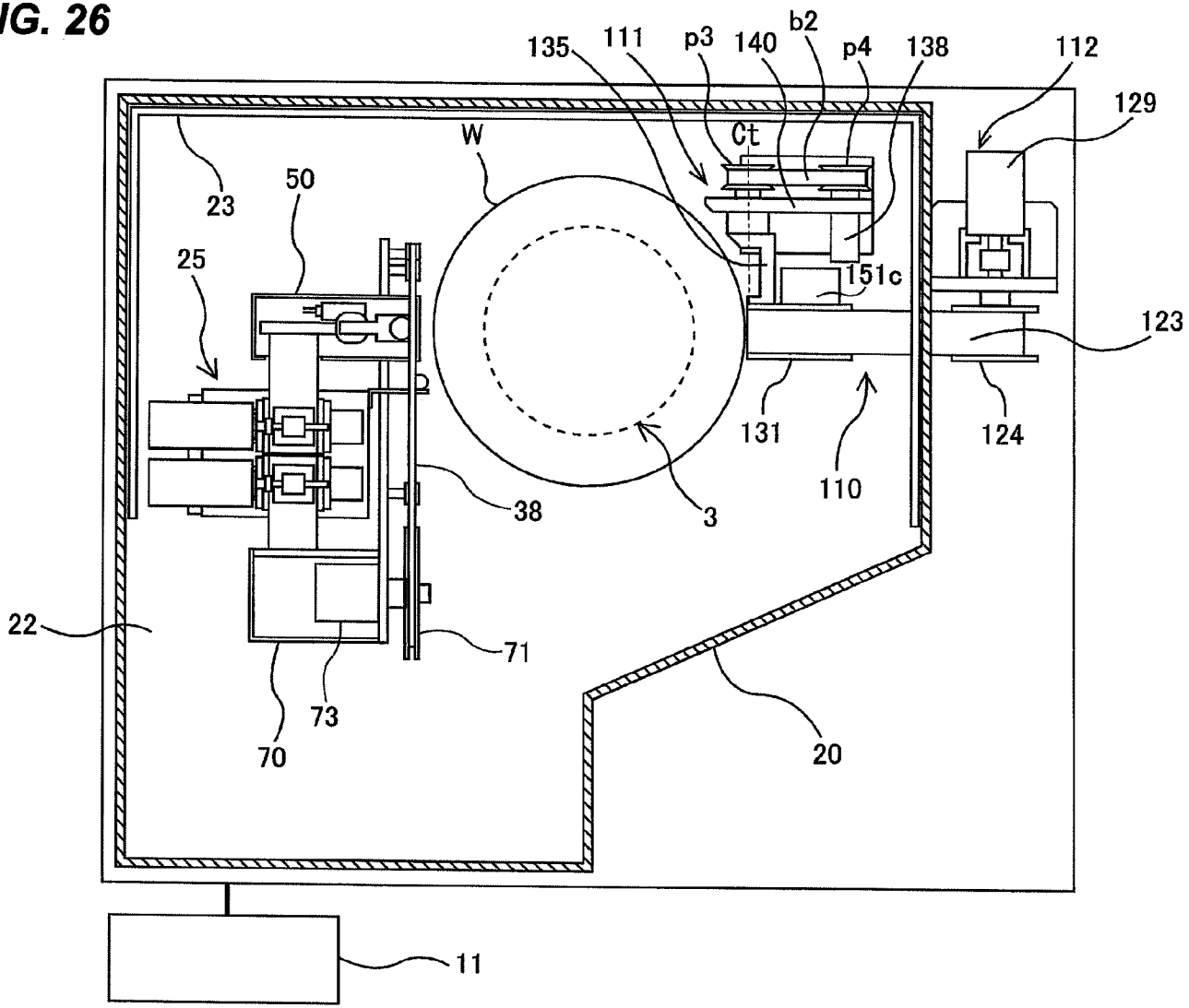
FIG. 26 is a plan view of the polishing apparatus having a top-edge polishing unit and a bevel polishing unit.
Figure 27:
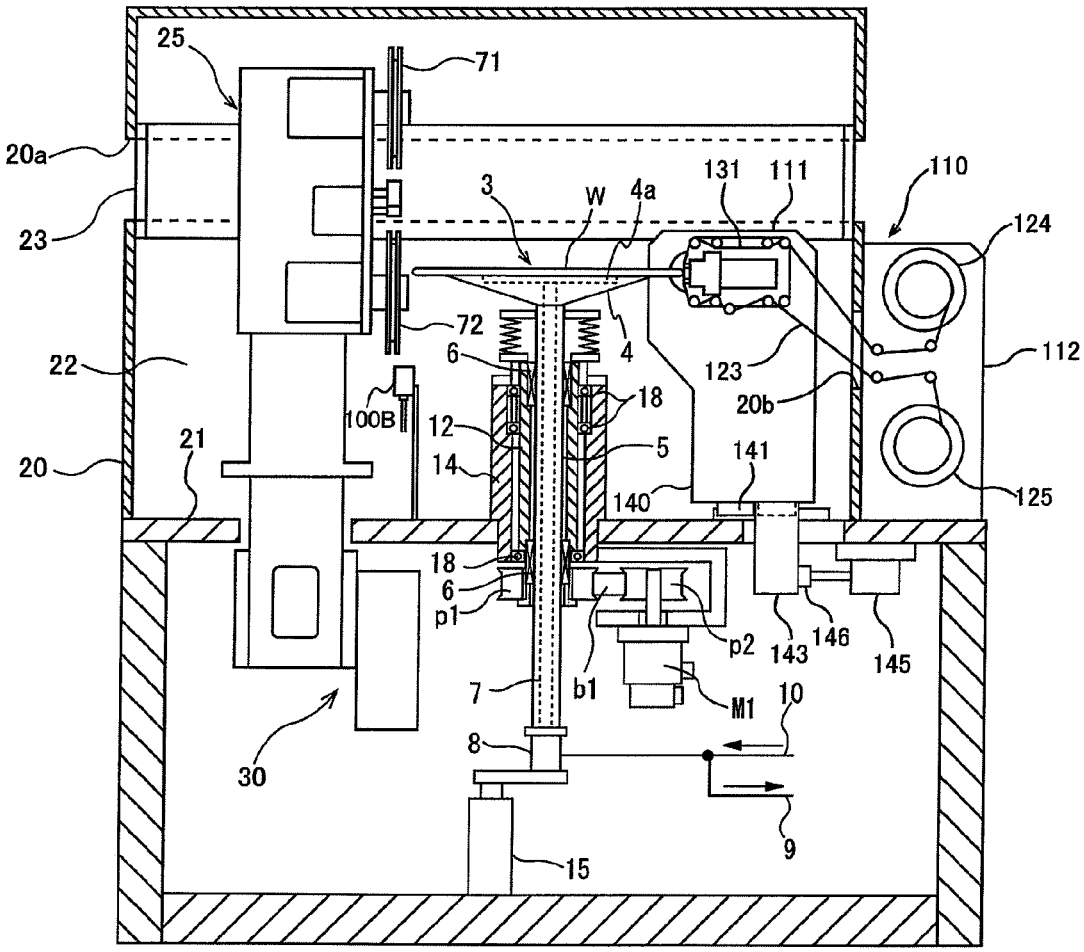
FIG. 27 is a vertical cross-sectional view of the polishing apparatus shown in FIG. 26.

FIG. 26 is a view showing a polishing apparatus having the above-described polishing unit 25 capable of polishing the top edge portion (hereinafter, the polishing unit 25 will be referred to as top-edge polishing unit) and a bevel polishing unit 110 capable of polishing the bevel portion (see the symbol B in FIG. 1A and FIG. 1B). FIG. 27 is a vertical cross-sectional view of the polishing apparatus shown in FIG. 26.

As shown in FIG. 26 and FIG. 27, the bevel polishing unit 110 has a polishing head assembly 111 configured to press a polishing tape 123 against the bevel portion of the substrate W so as to polish the bevel portion, and a polishing-tape supply and recovery mechanism 112 for supplying the polishing tape 123 to the polishing head assembly 111. The polishing head assembly 111 is located in the polishing chamber 22, while the polishing-tape supply and recovery mechanism 112 is located outside the polishing chamber 22.

The polishing-tape supply and recovery mechanism 112 has a supply reel 124 for supplying the polishing tape 123 to the polishing head assembly 111, and a recovery reel 125 for recovering the polishing tape 123 that has been used in polishing of the substrate W. Motors 129 and 129 are coupled to the supply reel 124 and the recovery reel 125, respectively (FIG. 26 shows only the motor 129 coupled to the supply reel 124). The motors 129 and 129 are configured to apply predetermined torque to the supply reel 124 and the recovery reel 125 so as to exert a predetermined tension on the polishing tape 123.

The polishing head assembly 111 has a polishing head 131 for pressing the polishing tape 123 against the peripheral portion of the substrate W. The polishing tape 123 is supplied to the polishing head 131 such that a polishing surface of the polishing tape 123 faces the substrate W. The polishing tape 123 is supplied to the polishing head 131 from the supply reel 124 through an opening 20*b* formed in the partition 20, and the polishing tape 123 that has been used in polishing of the substrate is recovered by the recovery reel 125 through the opening 20*b*.

The polishing head 131 is secured to one end of an arm 135, which is rotatable about an axis Ct extending parallel to the tangential direction of the substrate W. The other end of the arm 135 is coupled to a motor 138 via pulleys p3 and p4 and a belt b2. As the motor 138 rotates in a clockwise direction and a counterclockwise direction through a certain angle, the arm 135 rotates about the axis Ct through a certain angle. In this embodiment, the motor 138, the arm 135, the pulleys p3 and p4, and the belt b2 constitute a tilting mechanism for tilting the polishing head 131 with respect to the surface of the substrate W.

The tilting mechanism is mounted on a movable base 140. This movable base 140 is movably coupled to the base plate 21 via linear motion guides 141. The linear motion guides 141 extend linearly in the radial direction of the substrate W held on the substrate holder 3, so that the movable base 140 can move linearly in the radial direction of the substrate W. A connection plate 143, extending through the base plate 21, is secured to the movable base 140. A linear actuator 145 is coupled to the connection plate 143 via a joint 146. This linear actuator 145 is secured to the base plate 21 directly or indirectly.

The linear actuator 145 may comprise an air cylinder or a combination of a positioning motor and a ball screw. The linear actuator 145 and the linear motion guides 141 constitute a moving mechanism for linearly moving the polishing head 131 in the radial direction of the substrate W. Specifically, the moving mechanism is operable to move the polishing head 131 closer to and away from the substrate W along the linear motion guides 141. In contrast, the polishing-tape supply mechanism 112 is fixed to the base plate 21.

Figure 28:
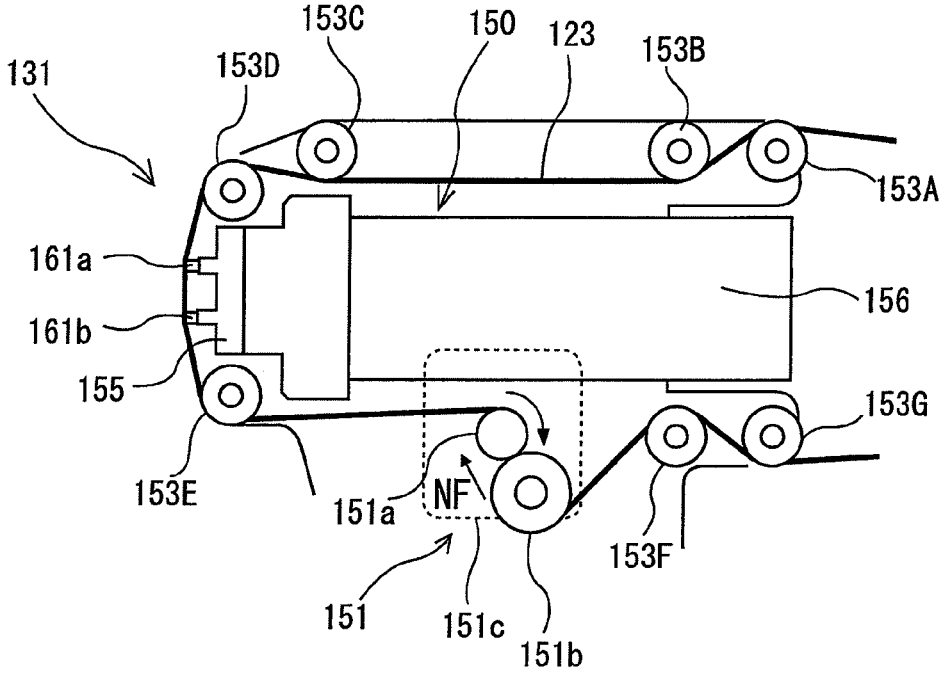
FIG. 28 is an enlarged view of a polishing head shown in FIG. 27.

FIG. 28 is an enlarged view of the polishing head 131 shown in FIG. 27. As shown in FIG. 28, the polishing head 131 has a pressing mechanism 150 configured to press the polishing surface of the polishing tape 123 against the substrate W with predetermined force. The polishing head 131 further has a tape-sending mechanism 151 configured to send the polishing tape 123 from the supply reel 124 to the recovery reel 125. The polishing head 131 has plural guide rollers 153A, 153B, 153C, 153D, 153E, 153E, and 153G, which guide the polishing tape 123 such that the polishing tape 123 travels in a direction perpendicular to the tangential direction of the substrate W.

The tape-sending mechanism 151 of the polishing head 131 includes a tape-sending roller 151*a*, a nip roller 151*b*, and a motor 151*c* configured to rotate the tape-sending roller 151*a*. The motor 151*c* is mounted on a side surface of the polishing head 131. The tape-sending roller 151*a* is provided on a rotational shaft of the motor 151*c*. The nip roller 151*b* is adjacent to the tape-sending roller 151*a*. The nip roller 151*b* is supported by a non-illustrated mechanism, which biases the nip roller 151*b* in a direction indicated by arrow NF in FIG. 28 (i.e., in a direction toward the tape-sending roller 151*a*) so as to press the nip roller 151*b* against the tape-sending roller 151*a*.

As the motor 151*c* rotates in a direction indicated by arrow in FIG. 28, the tape-sending roller 151*a* is rotated to send the polishing tape 123 from the supply reel 124 to the recovery reel 125 via the polishing head 131. The nip roller 151*b* is configured to be rotatable about its own axis.

The pressing mechanism 150 includes a pressing member 155 located at the rear side of the polishing tape 123 and an air cylinder 156 configured to move the pressing member 155 toward the peripheral portion of the substrate W. The polishing load on the substrate W is regulated by controlling air pressure supplied to the air cylinder 156.

Figure 29:
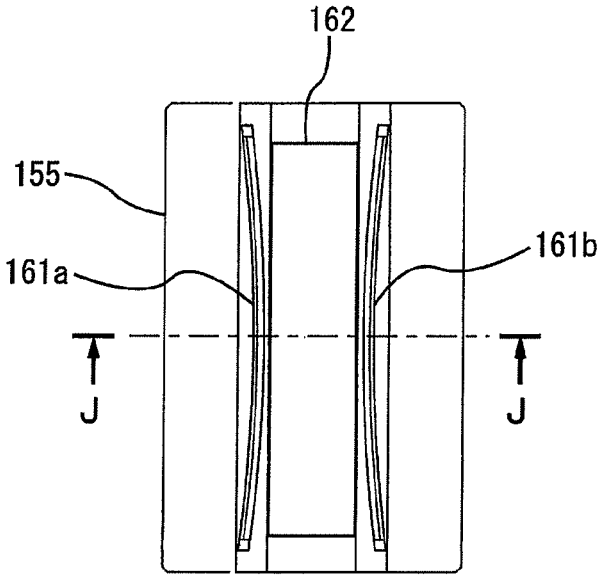
FIG. 29 is a front view of a pressing member shown in FIG. 28.
Figure 30:
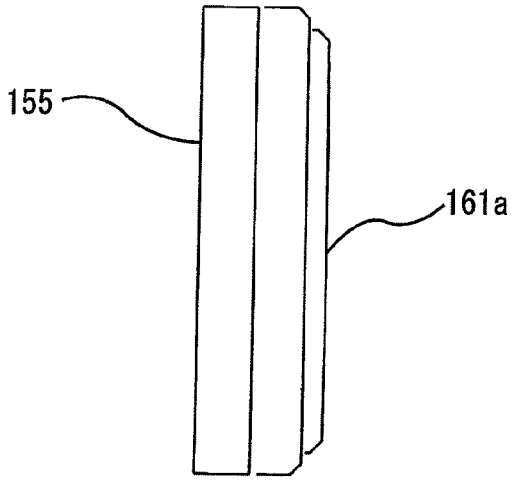
FIG. 30 is a side view of the pressing member shown in FIG. 29.
Figure 31:
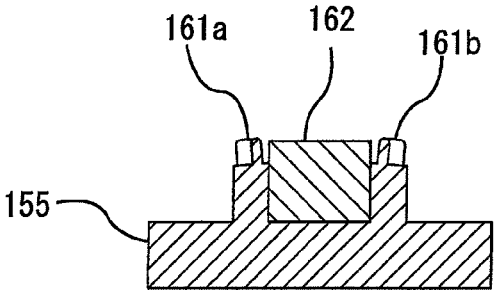
FIG. 31 is a cross-sectional view taken along line J-J in FIG. 29.

FIG. 29 is a front view of the pressing member 155 shown in FIG. 28, FIG. 30 is a side view of the pressing member 155 shown in FIG. 29, and FIG. 31 is a cross-sectional view taken along line J-J in FIG. 29. As shown in FIG. 29 through FIG. 31, the pressing member 155 has two protrusions 161*a* and 161*b* formed on a front surface thereof. These protrusions 161*a* and 161*b* are in a shape of rail and are arranged in parallel. The protrusions 161*a* and 161*b* are curved along the circumferential direction of the substrate W. More specifically, the protrusions 161*a* and 161*b* have a circular arc shape whose curvature is substantially the same as a curvature of the substrate W.

The two protrusions 161*a* and 161*b* are symmetrical about the rotational axis Ct. As shown in FIG. 29, the protrusions 161*a* and 161*b* are curved inwardly toward the rotational axis Ct as viewed from a front of the pressing member 155. The polishing head 131 is disposed such that a center line (i.e., the rotational axis Ct) extending between tip ends of the protrusions 161*a* and 161*b* coincides with a center of a thickness of the substrate W. The protrusions 161*a* and 161*b* are arranged such that the protrusions 161*a* and 161*b* are closer to the substrate W than the guide rollers 153D and 153E that are disposed at the front of the polishing head 131, so that the polishing tape 123 is supported from the rear side thereof by the protrusions 161*a* and 161*b*. The protrusions 161*a* and 161*b* are made from resin, such as PEEK (polyetheretherketone).

A pressing pad (bevel pad) 162 is provided between the two protrusions 161*a* and 161*b*. This pressing pad 162 is made from closed-cell foam material (e.g., silicone rubber) having elasticity. A height of the pressing pad 162 is slightly lower than a height of the protrusions 161*a* and 161*b*. When the pressing member 155 is moved toward the substrate W by the air cylinder 156 with the polishing head 131 in the horizontal position, the pressing pad 162 presses the polishing tape 123 from the rear side thereof against the bevel portion of the substrate W.

Figure 32:
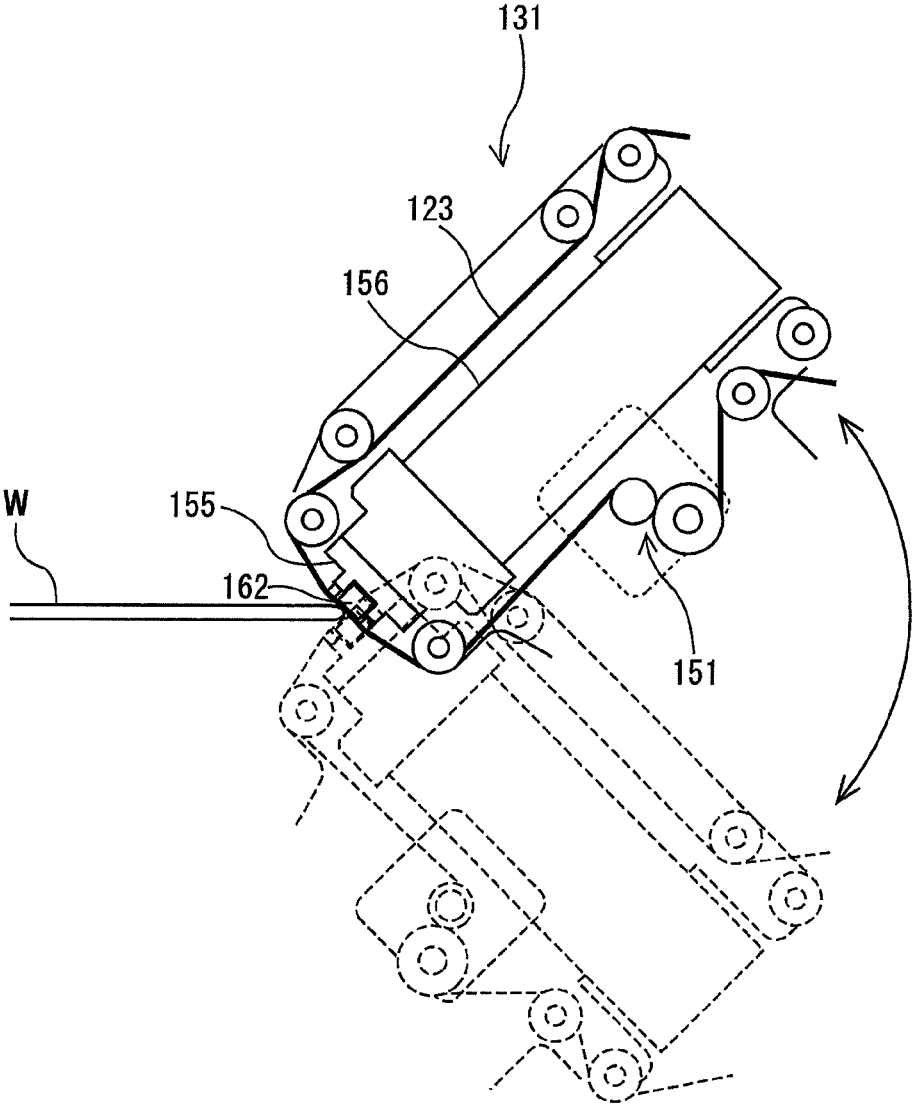
FIG. 32 is a view of the bevel polishing unit when polishing a bevel portion of the substrate.
Figure 33:
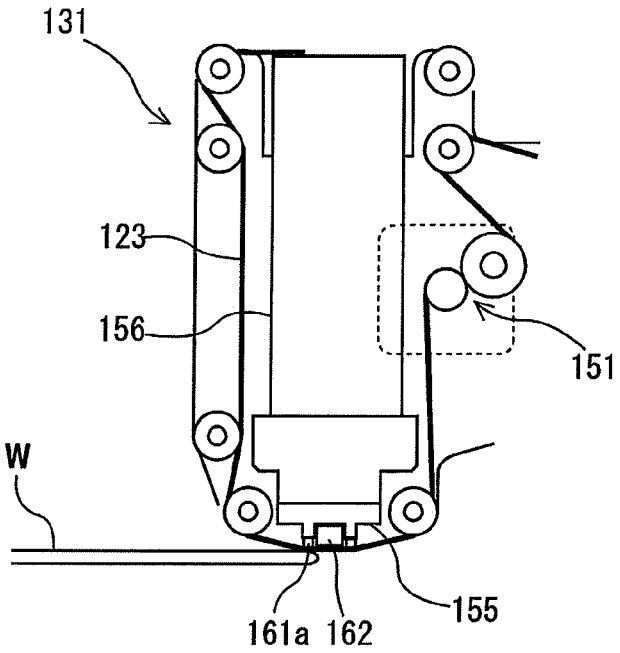
FIG. 33 is a view of the bevel polishing unit when polishing a top edge portion of the substrate.
Figure 34:
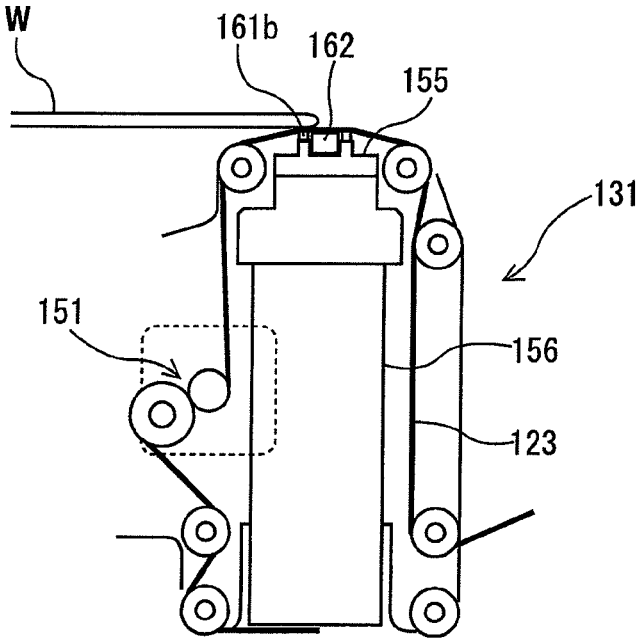
FIG. 34 is a view of the bevel polishing unit when polishing a bottom edge portion of the substrate.

When polishing the bevel portion of the substrate W, the polishing tape 123 is pressed against the bevel portion by the pressing pad 162 while a tilt angle of the polishing head 131 is changed continuously by the above-described tilting mechanism, as shown in FIG. 32. During polishing, the polishing tape 123 is sent at a predetermined speed by the tape-sending mechanism 151. Further, the polishing head 131 is capable of polishing the top edge portion and the bottom edge portion of the substrate W. Specifically, as shown in FIG. 33, the polishing head 131 is inclined upward to allow the protrusion 161*a* to press the polishing tape 123 against the top edge portion of the substrate W to thereby polish the top edge portion. Subsequently, as shown in FIG. 34, the polishing head 131 is inclined downward to allow the protrusion 161*b* to press the polishing tape 123 against the bottom edge portion of the substrate W to thereby polish the bottom edge portion.

The polishing apparatus shown in FIG. 26 and FIG. 27 is configured to be able to polish the peripheral portion of the substrate W in its entirety including the top edge portion, the bevel portion, and the bottom edge portion. For example, the bevel polishing unit 110 polishes the bevel portion of the substrate W, and subsequently the top-edge polishing unit 25 polishes the top edge portion of the substrate W. In this polishing apparatus, the top edge portion of the substrate W may be polished using either one or both of the top-edge polishing unit 25 and the bevel polishing unit 110. Although not shown in the drawings, multiple bevel polishing units 110 may be provided.

Figure 35A:
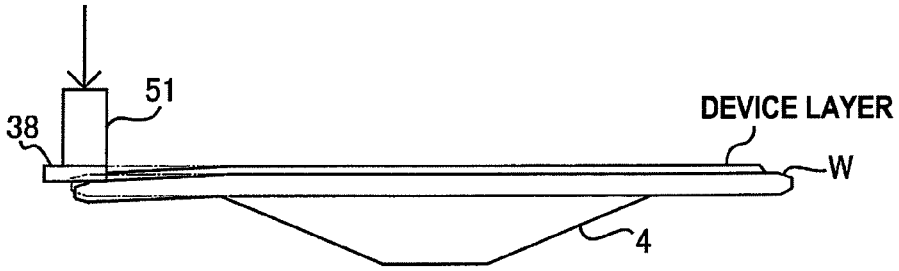
FIG. 35A is a view showing a state in which the substrate is bent as a result of being pressed by the pressing member through the polishing tape.
Figure 35B:
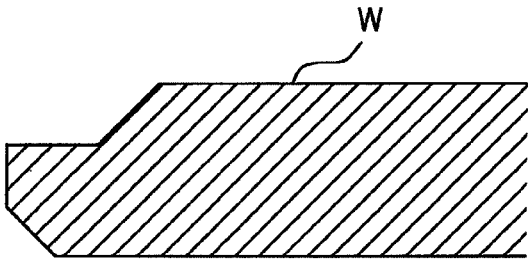
FIG. 35B is a cross-sectional view of the substrate that has been polished in the state shown in FIG. 35A.

FIG. 35A is a view showing a state in which the substrate W is bent as a result of being pressed by the pressing member 51 through the polishing tape 38, and FIG. 35B is a cross-sectional view of the substrate W that has been polished in the state shown in FIG. 35A. As shown in FIG. 35A, when an increased polishing load is exerted on the substrate W, the substrate W is greatly bent by the polishing load of the pressing member 51, and as a result, an oblique polished surface is formed on the substrate W as shown in FIG. 35B.

Figure 36:
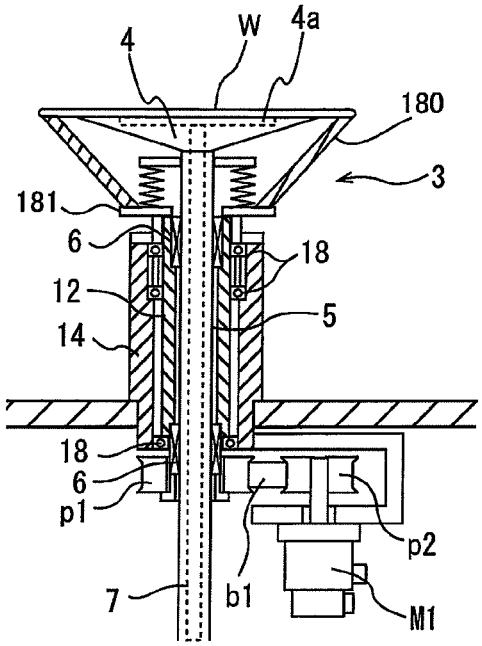
FIG. 36 is a vertical cross-sectional view showing the substrate holder having a supporting stage.

Thus, in an embodiment shown in FIG. 36, a supporting stage 180 for supporting the peripheral portion of the substrate W from below is provided in the substrate holder 3. The same parts as those shown in FIG. 6 will not be described below repetitively. The supporting stage 180 is fixed to a supporting stage base 181. This supporting stage base 181 is fixed to the upper end of the casing 12 and rotates in unison with the casing 12. Accordingly, the supporting stage 180 rotates in unison with the casing 12 and the holding stage 4.

Figure 37:
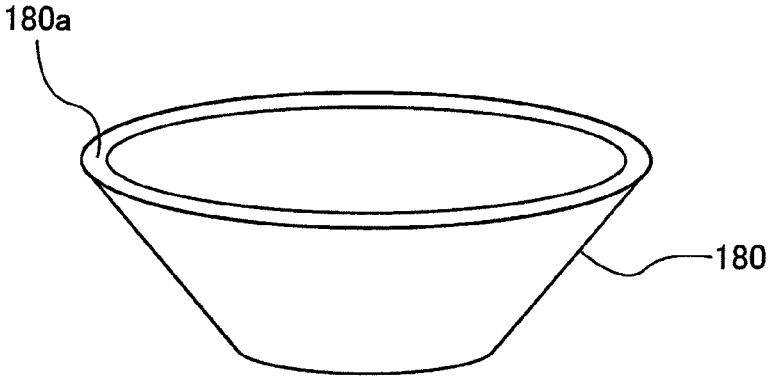
FIG. 37 is a perspective view of the supporting stage.

The supporting stage 180 has an inverted truncated cone shape as shown in FIG. 37 for supporting a lower surface of the peripheral portion of the substrate W in its entirety. The lower surface of the peripheral portion of the substrate W supported by the supporting stage 180 is a region including at least the bottom edge portion E2 shown in FIG. 1A and FIG. 1B. The supporting stage 180 has an annular upper surface 180*a* that provides a supporting surface for supporting the lower surface of the peripheral portion of the substrate W. When the substrate W is polished, an outermost edge of the supporting stage 180 and an outermost edge of the substrate W approximately coincide with each other.

Use of such supporting stage 180 can prevent the substrate W from being bent when the pressing member 51 presses the polishing tape 38 against the substrate W. Therefore, the edge of the polishing tape 38 can polish the peripheral portion of the substrate W to form a perpendicular edge surface of the device layer. Because the supporting stage 180 supports the lower surface of the peripheral portion of the substrate W in its entirety, the polishing tape 38 can polish the peripheral portion of the substrate W uniformly, compared with a case of using a substrate supporting mechanism that supports only a part of the substrate as disclosed in the Japanese laid-open patent publication No. 2009-208214.

Figure 38:
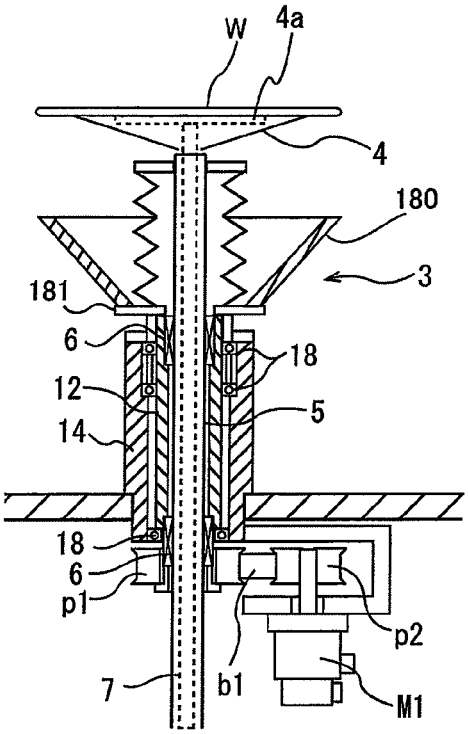
FIG. 38 is a view showing a state in which the holding stage and the substrate held on the upper surface of the holding stage are elevated relative to the supporting stage.

The ball spline bearings 6 are disposed between the hollow shaft 5 and the casing 12, so that the hollow shaft 5 can move up and down relative to the casing 12. Therefore, the holding stage 4 coupled to an upper end of the hollow shaft 5 can move up and down relative to the casing 12 and the supporting stage 180. FIG. 38 shows a state in which the holding stage 4 and the substrate W held on the upper surface of the holding stage 4 are elevated relative to the supporting stage 180.

The substrate W is transported into the polishing chamber 22 by the hands 105 of the transporting mechanism, and then the holding stage 4 is elevated by the air cylinder 15 (see FIG. 23), while the supporting stage 180 is not elevated. The substrate W is held on the holding stage 4, and then the holding stage 4 is lowered, together with the substrate W, to the predetermined polishing position where the lower surface of the peripheral portion of the substrate W in its entirety is supported by the supporting surface 180*a* of the supporting stage 180. In this state, the substrate W is polished by the polishing tape 38. When the substrate W is being polished, the supporting stage 180 is rotated together with the substrate W. After polishing of the substrate W is terminated, the holding stage 4 is elevated together with the substrate W in order to remove the substrate W. Because the supporting stage 180 is not elevated when the holding stage 4 is elevated, the hands 105 can securely hold the substrate W.

The pressing member 51 holds the polishing tape 38 by the vacuum suction with the edge of the pressing member 51 coinciding with the edge of the polishing tape 38, and presses the polishing surface of the polishing tape 38 against the peripheral portion of the substrate W (see FIG. 17C and FIG. 18). As a result, the device layer formed on the surface of the substrate W is polished to have an edge surface perpendicular to the surface of the substrate W.

Figure 39:
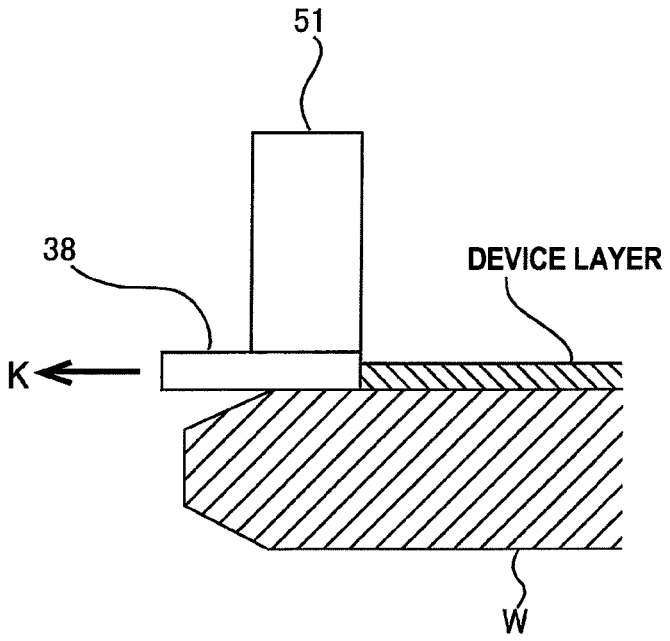
FIG. 39 is a view showing the polishing tape with a horizontal load applied thereto.
Figure 40:
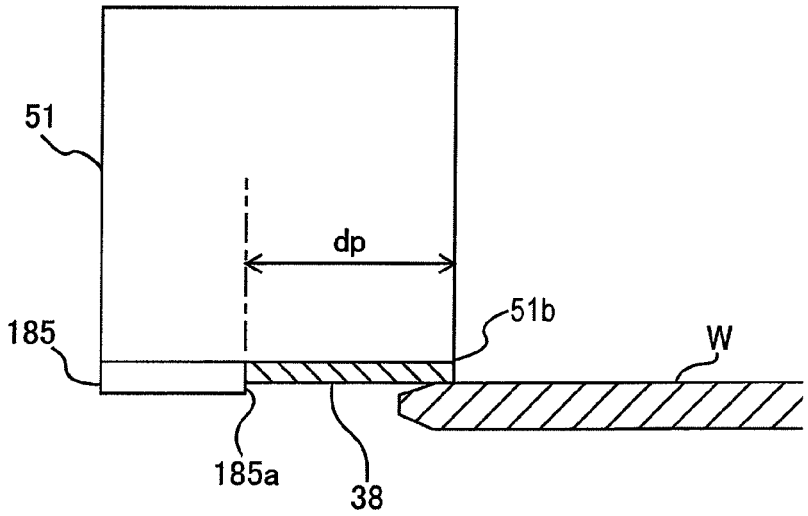
FIG. 40 is a view showing an embodiment having a tape stopper.

The polishing tape 38 may receive a horizontal load due to contact with the substrate W or an influence of the shape of the peripheral portion of the substrate W. As a result, as indicated by arrow K in FIG. 39, the polishing tape 38 may be forced to move outwardly of the substrate W. Thus, a tape stopper 185 for restricting a horizontal movement of the polishing tape 38 is provided on the pressing member 51 as shown in FIG. 40. The tape stopper 185 is arranged outwardly of the polishing tape 38 with respect to the radial direction of the substrate W so as to restrict an outward movement of the polishing tape 38. This tape stopper 185 can prevent the polishing tape 38 from moving outwardly of the substrate W. Therefore, a polishing profile and a polishing width of the substrate W can be stable. A distance dp between an inner side surface 185*a* of the tape stopper 185 and an edge 51*b* of the pressing member 51 is set to be slightly larger than the width of the polishing tape 38.

Figure 41:
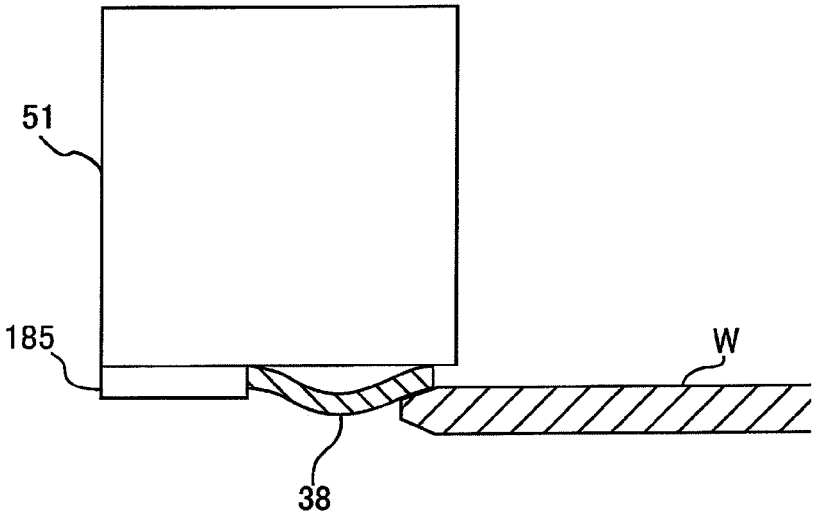
FIG. 41 is a view showing a state in which the polishing tape is distorted under a horizontal load.

When the tape stopper 185 receives the outward movement of the polishing tape 38, the polishing tape 38 may be distorted as shown in FIG. 41. Thus, in an embodiment shown in FIG. 42, in order to prevent the distortion of the polishing tape 38, a tape cover 186 is provided in proximity to the polishing surface of the polishing tape 38. The tape cover 186 is secured to the tape stopper 185 and is arranged so as to cover a large part of the polishing surface of the polishing tape 38. The tape cover 186 is located below the polishing tape 38 such that a small clearance dg is formed between the polishing surface of the polishing tape 38 and an upper surface of the tape cover 186. The polishing tape 38 is arranged between the pressing member 51 and the tape cover 186. By providing such tape cover 186, the polishing tape 38 can be prevented from being distorted and can be kept flat. Therefore, the polishing profile and the polishing width of the substrate W can be stable.

Figure 42:
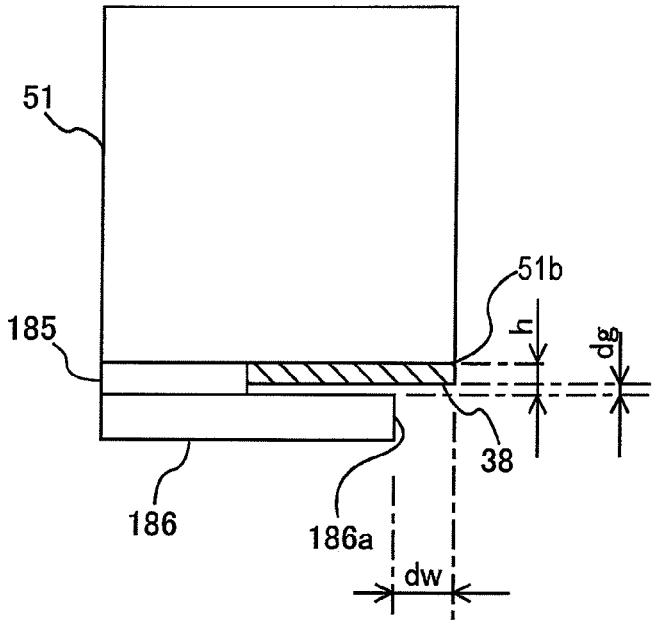
FIG. 42 is a view showing an embodiment having the tape stopper and a tape cover.

As shown in FIG. 42, the polishing tape 38 is located in a space surrounded by the pressing member 51, the tape stopper 185, and the tape cover 186. A clearance h between the lower surface of the pressing member 51 and the upper surface of the tape cover 186 is larger than a thickness of the polishing tape 38. A clearance dg between the polishing tape 38 and the tape cover 186 is smaller than a thickness of the substrate W.

The tape cover 186 has an inner side surface 186*a* located outwardly of the edge 51*b* of the pressing member 51 with respect to the radial direction of the substrate W. Therefore, the polishing surface of the polishing tape 38 is exposed by a distance dw between the edge 51*b* of the pressing member 51 and the inner side surface 186*a* of the tape cover 186. Polishing of the substrate W is performed by this exposed polishing surface. The distance dw is slightly larger than a width of a region to be polished so that the substrate W does not contact the tape cover 186 during polishing.

In the structures shown in FIG. 42, the tape stopper 185 receives the horizontal load acting on the polishing tape 38.

As a result, the pressing member 51 may move outwardly together with the polishing tape 38. Such a movement of the pressing member 51 destabilizes the polishing profile and the polishing width. Thus, in an embodiment shown in FIG. 43, a movement-restricting mechanism for restricting the outward movement of the pressing member 51 is provided. This movement-restricting mechanism has a projecting member 190 fixed to the pressing member 51 and further has a side stopper 191 for restricting a horizontal movement of this projecting member 190. In this embodiment, a plunger is used as the projecting member 190.

The plunger (projecting member) 190 penetrates the pressing member 51. The side stopper 191 is disposed outwardly of the plunger 190 with respect to the radial direction of the substrate W so as to receive an outward movement of the plunger 190. The side stopper 191 is secured to the lower surface of the box 62 of the polishing head 50, so that a position of the side stopper 191 is fixed. The plunger 190 and the side stopper 191 are arranged in proximity to each other, and a clearance dr between the plunger 190 and the side stopper 191 is in a range of 10 μm to 100 μm. With this structure, when the pressing member 51 moves outwardly upon receiving the horizontal load from the polishing tape 38 during polishing, the plunger 190 is brought into contact with the side stopper 191, whereby the outward movements of the pressing member 51 and the polishing tape 38 are restricted. Therefore, the polishing profile and the polishing width of the substrate W can be stable.

Figure 43:
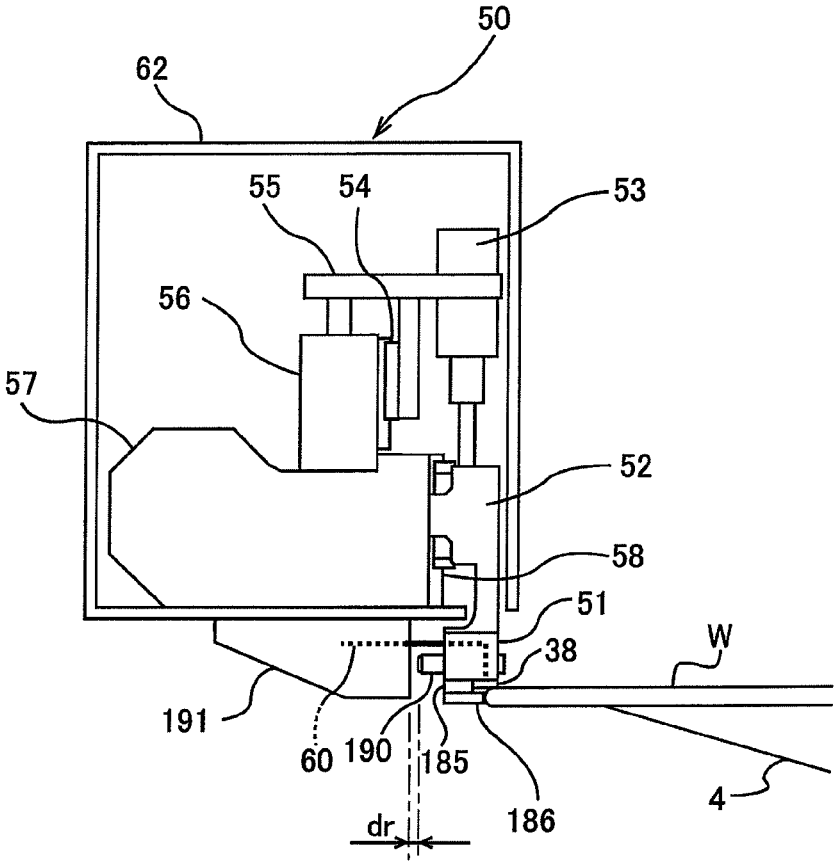
FIG. 43 is a view showing an embodiment having a movement-restricting mechanism for restricting an outward movement of the pressing member.
Figure 44:
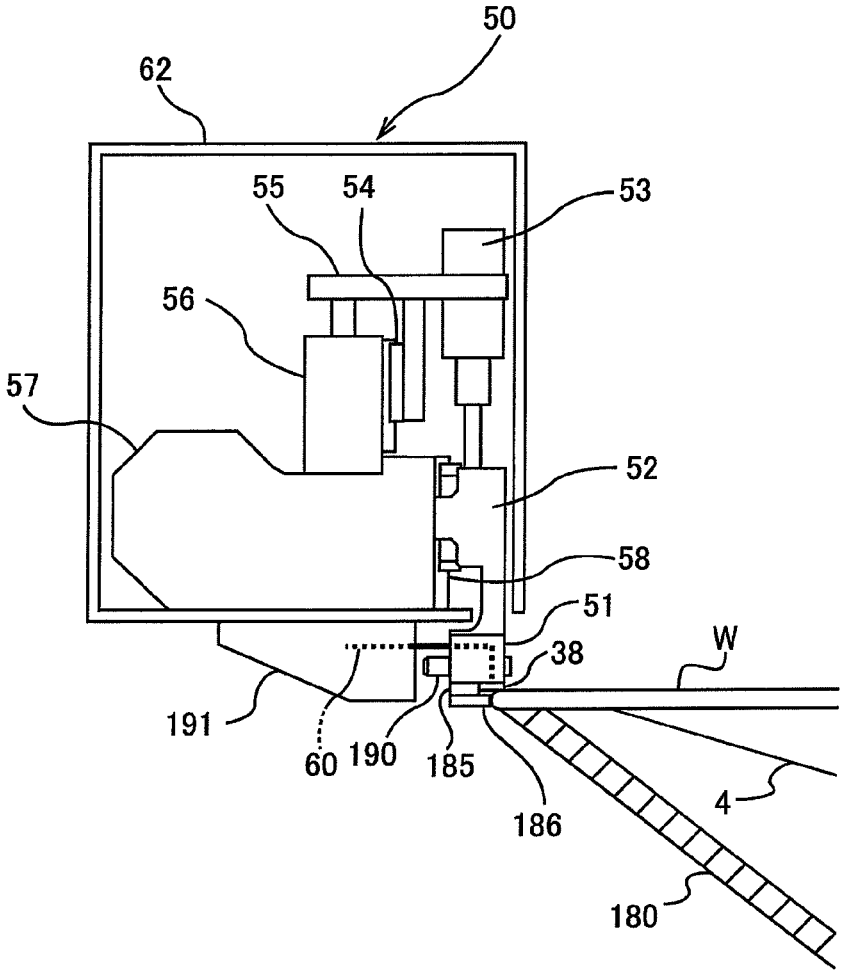
FIG. 44 is a view showing an example of a combination of the embodiment shown in FIG. 36 and the embodiment shown in FIG. 43.

The embodiments shown in FIG. 36 through FIG. 43 can be combined in an appropriate manner. For example, FIG. 44 shows an example in which the supporting stage 180 shown in FIG. 36 and the polishing head 50 shown in FIG. 43 are combined. This structure shown in FIG. 44 can prevent the deflection of the substrate W and can further prevent the movement and the distortion of the polishing tape 38. The embodiments shown in FIG. 36 through FIG. 44 can be applied to the polishing apparatus shown in FIG. 5 and FIG. 26.

Figure 45:
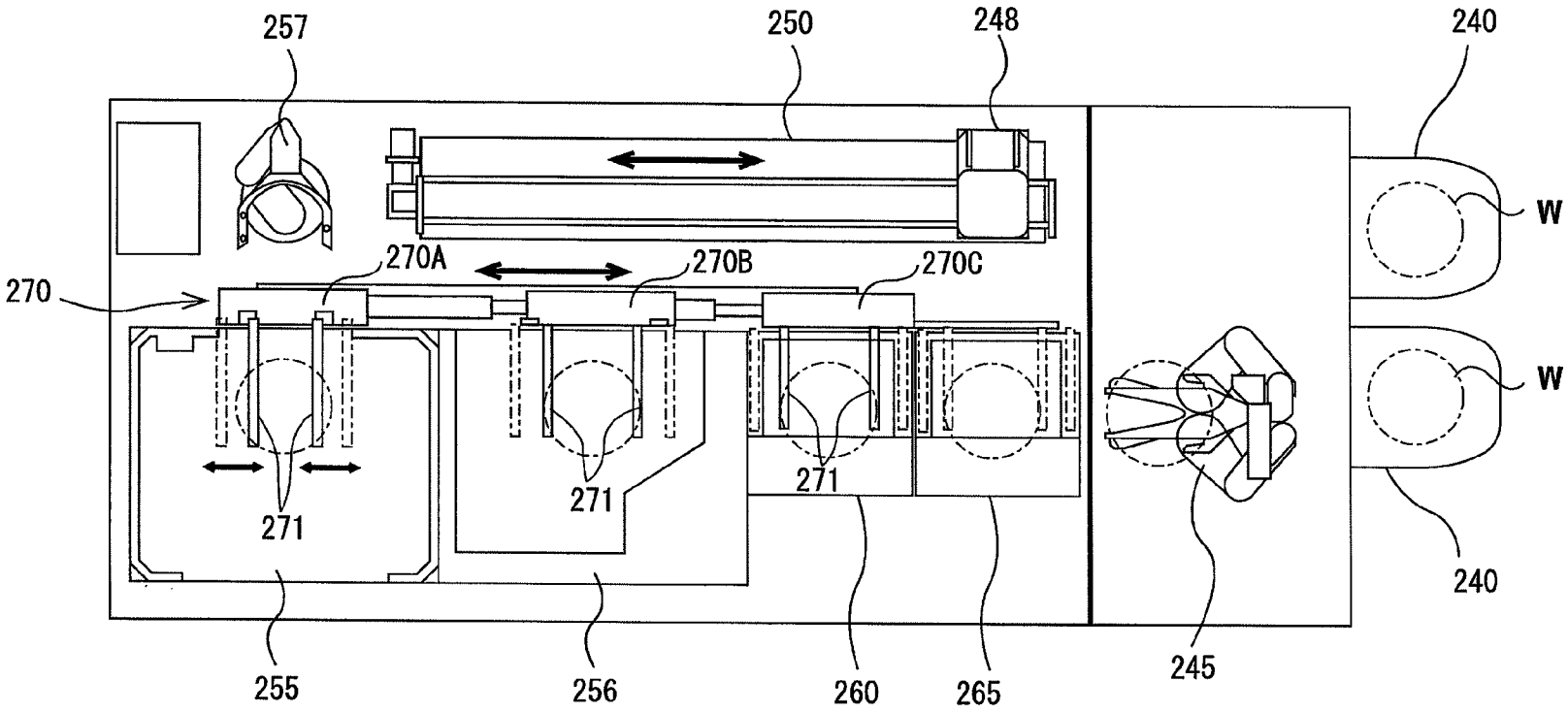
FIG. 45 is a top view of a substrate processing apparatus having a plurality of substrate processing modules including a polishing module.

FIG. 45 is a top view of a substrate processing apparatus having a plurality of substrate processing modules including a polishing module. This substrate processing apparatus includes two loading ports 240 configured to introduce the substrate W into the substrate processing apparatus, a first transfer robot 245 configured to remove the substrate W from wafer cassettes (not shown in the drawing) on the loading ports 240, a notch aligner 248 configured to detect the position of a notch portion of the substrate W and to rotate the substrate W such that the notch portion is in a predetermined position, a notch-aligner moving mechanism 250 configured to move the notch aligner 248, a notch polishing module (a first polishing module) 255 configured to polish the notch portion of the substrate W, a second transfer robot 257 configured to transfer the substrate W from the notch aligner 248 to the notch polishing module 255, a top-edge polishing module (a second polishing module) 256 configured to polish the top edge portion of the substrate W, a cleaning module 260 configured to clean the polished substrate W, a drying module 265 configured to dry the cleaned substrate W, and a transfer mechanism 270 configured to transfer the substrate W from the notch polishing module 255 to the top-edge polishing module 256, the cleaning module 260, and the drying module 265 successively in this order.

A known notch polishing apparatus, such as one disclosed in Japanese laid-open patent publication No. 2009-154285, can be used as the notch polishing module 255. The above-described polishing apparatus shown in FIG. 5 or FIG. 26 can be used as the top-edge polishing module 256. The cleaning module 260 may be a roll-sponge type cleaning device that is configured to bring rotating roll sponges into contact with the upper surface and the lower surface of the rotating substrate W while supplying liquid onto the substrate W. The drying module 265 may be a spin drying device configured to rotate the substrate W at high speed.

The notch polishing module 255, the top-edge polishing module 256, the cleaning module 260, and the drying module 265 (hereinafter, these modules will be collectively referred to as substrate processing modules) are arranged in a line. The transfer mechanism 270 is arranged along an arrangement direction of these substrate processing modules. The transfer mechanism 270 has hand units 270A, 270B, and 270C. Each hand unit has a pair of hands 271 for holding the substrate W and is configured to transfer the substrate W between the neighboring substrate processing modules. More specifically, the hand unit 270A is operable to remove the substrate W from the notch polishing module 255 and transfer it to the top-edge polishing module 256, the hand unit 270B is operable to remove the substrate W from the top-edge polishing module 256 and transfer it to the cleaning module 260, and the hand unit 270C is operable to remove the substrate W from the cleaning module 260 and transfer it to the drying module 265.

These hand units 270A, 270B, and 270C are movable linearly along the arrangement direction of the substrate processing modules. The hand units 270A, 270B, and 270C are configured to remove the substrates W from the substrate processing modules simultaneously, move simultaneously, and transfer the substrates W into the neighboring substrate processing modules simultaneously.

Next, overall processing flow of the substrate W will be described. The first transfer robot 245 removes the substrate W from the wafer cassette, and places the substrate W onto the notch aligner 248. The notch aligner 248 is moved together with the substrate W by the notch-aligner moving mechanism 250 to a position near the second transfer robot 257. During this movement, the notch aligner 248 detects the position of the notch portion of the substrate W and rotates the substrate W such that the notch portion is in a predetermined position.

Then, the second transfer robot 257 receives the substrate W from the notch aligner 248, and transfers the substrate W into the notch polishing module 255. The notch portion of the substrate W is polished by the notch polishing module 255. The polished substrate W is transferred to the top-edge polishing module 256, the cleaning module 260, and the drying module 265 successively in this order by the hand units 270A, 270B, and 270C as described above, so that the substrate W is processed in these substrate processing modules. The processed substrate W is transferred by the first transfer robot 245 into the wafer cassette on the loading port 240.

The notch polishing module 255 and the top-edge polishing module 256 are removably installed in the substrate processing apparatus. Therefore, it is possible to remove the notch polishing module 255 and/or the top-edge polishing module 256 and to install different type of polishing module in the substrate processing apparatus. For example, the polishing apparatus according to above-described embodiment that can polish the top edge portion of the substrate W may be used as the first polishing module, and a known bevel polishing module that can polish the bevel portion of the substrate W may be used as the second polishing module.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. An apparatus for polishing a peripheral portion of a substrate, said apparatus comprising:

a substrate holder configured to hold the substrate and to rotate the substrate about a central axis of said substrate holder;

guide rollers configured to support a polishing tape; and a polishing head having a pressing member configured to press an edge of the polishing tape against the peripheral portion of the substrate, said pressing member being located above said substrate holder, wherein said pressing member has a tape contact surface that contacts the polishing tape to press the edge of the polishing tape against the peripheral portion of the substrate, wherein said guide rollers are arranged such that a horizontal part of a longitudinal edge of the polishing tape, when the horizontal part of the longitudinal edge of the polishing tape is in contact with the peripheral portion of the substrate, is perpendicular to the central axis of said substrate holder and substantially perpendicular to a radial direction of the substrate at a location where said pressing member is to press the horizontal part of the longitudinal edge of the polishing tape against the peripheral portion of the substrate, wherein said polishing head has a tape stopper configured to restrict an outward movement of the polishing tape in the radial direction of the substrate, and wherein said tape stopper is arranged outward of the polishing tape with respect to the radial direction of the substrate.

2. The apparatus according to claim 1, wherein said polishing head further has a tape cover arranged in proximity to the polishing surface of the polishing tape.

3. The apparatus according to claim 2, wherein a clearance between said tape cover and said pressing member is larger than a thickness of the polishing tape.

4. The apparatus according to claim 2, wherein said tape cover is located just below said tape contact surface of said pressing member.

5. The apparatus according to claim 2, wherein the polishing tape is located in a space surrounded by said pressing member, said tape stopper, and said tape cover.

6. The apparatus according to claim 2, wherein said tape cover is secured to said tape stopper.

7. The apparatus according to claim 1, wherein:

said polishing head includes a projecting member fixed to said pressing member, and a side stopper configured to receive a horizontal movement of said projecting member; and said side stopper is arranged outwardly of said projecting member with respect to the radial direction of the substrate.

8. The apparatus according to claim 1, wherein said tape stopper is located radially outward of a contact point of the polishing tape and the substrate.

9. The apparatus according to claim 1, wherein said tape stopper has an inner side surface that contacts an outer side surface of the polishing tape.

10. The apparatus according to claim 9, wherein said tape contact surface is perpendicular to said inner side surface of said tape stopper.

11. The apparatus according to claim 9, wherein a distance between said inner side surface of said tape stopper and an edge of said pressing member is larger than a width of the polishing tape.

12. The apparatus according to claim 1, wherein said tape stopper is secured to a lower surface of said pressing member.

13. The apparatus according to claim 1, wherein said substrate holder has a substrate holding surface, and said tape contact surface is parallel to said substrate holding surface.

14. An apparatus for polishing a peripheral portion of a substrate, said apparatus comprising:

a substrate holder configured to hold the substrate and to rotate the substrate about a central axis of said substrate holder;

guide rollers configured to support a polishing tape;

a polishing head having a pressing member configured to press an edge of the polishing tape against the peripheral portion of the substrate, said pressing member being located above said substrate holder; and an actuator configured to move said pressing member in a vertical direction, wherein said guide rollers are arranged such that a horizontal part of a longitudinal edge of the polishing tape, when the horizontal part of the longitudinal edge of the polishing tape is in contact with the peripheral portion of the substrate, is perpendicular to the central axis of said substrate holder and substantially perpendicular to a radial direction of the substrate at a location where said pressing member is to press the horizontal part of the longitudinal edge of the polishing tape against the peripheral portion of the substrate, wherein said polishing head has a tape stopper configured to restrict an outward movement of the polishing tape in the radial direction of the substrate, and wherein said tape stopper is arranged outward of the polishing tape with respect to the radial direction of the substrate.

* * * * *